US008123210B1

(12) United States Patent
Murray

(10) Patent No.: US 8,123,210 B1
(45) Date of Patent: Feb. 28, 2012

(54) PAPER FEEDING ASSEMBLY FOR PRINTERS

(75) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/913,139

(22) Filed: Oct. 27, 2010

(51) Int. Cl.
*B65H 5/22* (2006.01)

(52) U.S. Cl. ..... 271/4.04; 271/10.04; 271/10.09; 271/3.2; 271/3.18; 271/4.08

(58) Field of Classification Search ..... 271/4.04, 271/10.04, 10.09, 10.11, 3.2, 3.18, 4.08, 271/4.1, 272, 275, 314; 74/417, 423, 665 H, 74/665 GB
See application file for complete search history.

(56) References Cited

U.S. PATENT DOCUMENTS 3,408,954 A * 11/1968 Kademann et al. ..... 105/34.1
3,888,138 A * 6/1975 Hiersig ..... 74/665 G
4,699,016 A * 10/1987 Moll ..... 74/417
4,721,297 A * 1/1988 Katayama ..... 271/10.04
5,319,418 A * 6/1994 Fujimoto et al. ..... 399/167
5,390,906 A * 2/1995 Ishii ..... 271/10.04
5,393,044 A * 2/1995 Hagihara et al. ..... 271/10.04
6,672,581 B2 * 1/2004 Lee et al. ..... 271/164

* cited by examiner

*Primary Examiner* — David H Bollinger
(74) *Attorney, Agent, or Firm* — Peyton C. Watkins

(57) ABSTRACT

A paper feeding apparatus for a printer includes a motor; a first roller assembly includes a first roller having a first end, a second end and an axis; a first gear disposed at the first end of the first roller, wherein the first gear is configured to be driven by the motor; and a second gear disposed at the second end of the first roller, wherein the second gear having a first bevel gear; a drive shaft including a first end, a second end and an axis, wherein the first end of the drive shaft having a second bevel gear that is configured to engage with the first bevel gear of the second gear of the first roller assembly, and wherein the second end of the drive shaft having a third bevel gear; and a second roller assembly having a second roller and a fourth bevel gear that is configured to engage with the third bevel gear at the second end of the drive shaft.

17 Claims, 22 Drawing Sheets

PAPER FEEDING ASSEMBLY FOR PRINTERS

CROSS-REFERENCE TO RELATED APPLICATIONS

Reference is made to commonly assigned, co-pending U.S. patent application Ser. No. 12/913,081, filed Oct. 27, 2010, entitled: "Recording Media Path in a Multifunction Printer", co-pending U.S. patent application Ser. No. 12/913,100, filed Oct. 27, 2010, entitled: "Inclined Motor in an Inkjet Printer", and co-pending U.S. patent application Ser. No. 12/913,115, filed Oct. 27, 2011, entitled: "Method of Assembling a Multifunction Printer" the disclosures of which are incorporated herein.

FIELD OF THE INVENTION

This invention pertains generally to paper feeding in a printer and more particularly to the transmission of rotational motion from a first roller assembly to a second roller assembly.

BACKGROUND OF THE INVENTION

Many printers, including many inkjet printers, use a carriage-based architecture, which has advantages in size, performance, and cost. In the inkjet carriage printer, a printhead is mounted in a carriage that is moved back and forth across the region of printing. To print an image on a sheet of paper or other recording medium (sometimes generically referred to as paper herein), the recording medium is advanced a given distance along a recording medium advance direction and then momentarily stopped. While the recording medium is stopped and supported on a platen, the printhead carriage is moved along a carriage scan direction. The carriage scan direction extends substantially perpendicular to the recording medium advance direction. In the course of printhead travel along the carriage scan direction, controllable marking elements in the printhead record marks on the recording medium—for example by ejecting drops from an inkjet printhead. After the carriage has printed a swath of the image while traversing the recording medium, the recording medium is advanced incrementally, the carriage direction of motion is reversed, and marking is repeated with printhead movement in the reverse direction. By repeating this process a number of times, the printer forms the image onto the recording medium, swath by swath.

By way of example, FIG. 1 shows a portion of a prior art carriage printer 300, with some parts hidden so that other parts can be more clearly seen. Printer 300 has a printing region 303 across which a carriage 200 is moved back and forth along a carriage scan direction 305 that extends along the X axis between the right side 306 and the left side 307 of printer 300 while printing on recording medium that is supported by the platen that provides printing region 303. Carriage motor 380 moves a belt 384 attached to carriage 200 in order to move carriage 200 back and forth along carriage guide rail 382. In this way, carriage 200 is actuable to move along a carriage scan direction 305. Printhead 250 is mounted in carriage 200, and ink supplies 262 and 264 are mounted in the printhead 250. In this orientation of printhead 250, the droplets of ink are ejected downward onto the recording media in printing region 303 in the view of FIG. 1, Ink supply 262, in this example, contains five ink sources cyan, magenta, yellow, photo black, and colorless protective fluid, while ink supply 264 contains the ink source for text black.

Toward the left side 307 in the example of FIG. 1 is a maintenance station 330. Toward the rear 309 of the printer in this example is located an electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics for controlling the printing process, and an optional connector for a cable to a host computer.

Paper, or other recording medium is loaded along paper load entry direction 302 toward the front 308 of printer 300. Printed paper traveling from the rear 309 exits along direction 304. In this example, both the paper load entry direction 302 and the paper exit direction 304 are parallel to the Y axis. A feed roller 312 includes a feed roller shaft along its axis, and a feed roller gear 311 is mounted on the feed roller shaft. The motor that powers the paper advance rollers is not shown in FIG. 1, but a hole 310 in the framework at the right side 306 of the printer 300 is where the motor-gear (not shown) protrudes through in order to engage feed roller gear 311, as well as the gear for the discharge roller (not shown). Bolt holes for attaching this paper advance motor are shown on both sides of hole 310. For normal paper pick-up and feeding, all rollers rotate in forward direction 313. The motor that powers the paper advance rollers provides power directly to the teed roller and the discharge roller, but also provides power indirectly to a pick-up roller and a turn roller (not shown in FIG. 1) that respectively pick up a sheet of recording medium from the paper load entry region, and turn the direction of paper from entry direction 302 to exit direction 304. In conventional printers, power is transmitted from the feed roller 312 to respective gear trains to power the pick-up roller and the turn roller. Such gear trains work well, but a gear train having many gears tends to add to both the expense and the noise of the printing apparatus.

What is needed is a paper feeding apparatus that transmits power from the feed roller to another roller assembly in the printer in a quieter way and for less expense than is associated with the conventional gear train.

SUMMARY OF THE INVENTION

A paper feeding apparatus for a printer comprises a motor; a first roller assembly including: a) a first roller having a first end, a second end and an axis; b) a first gear disposed at the first end of the first roller, wherein the first gear is configured to be driven by the motor; and c) a second gear disposed at the second end of the first roller, wherein the second gear comprises a first bevel gear; a drive shaft including a first end, a second end and an axis, wherein the first end of the drive shaft comprises a second bevel gear that is configured to engage with the first bevel gear of the second gear of the first roller assembly, and wherein the second end of the drive shaft comprises a third bevel gear; and a second roller assembly including a second roller and a fourth bevel gear that is configured to engage with the third bevel gear at the second end of the drive shaft.

DETAILED DESCRIPTION OF THE INVENTION

Figure 2:
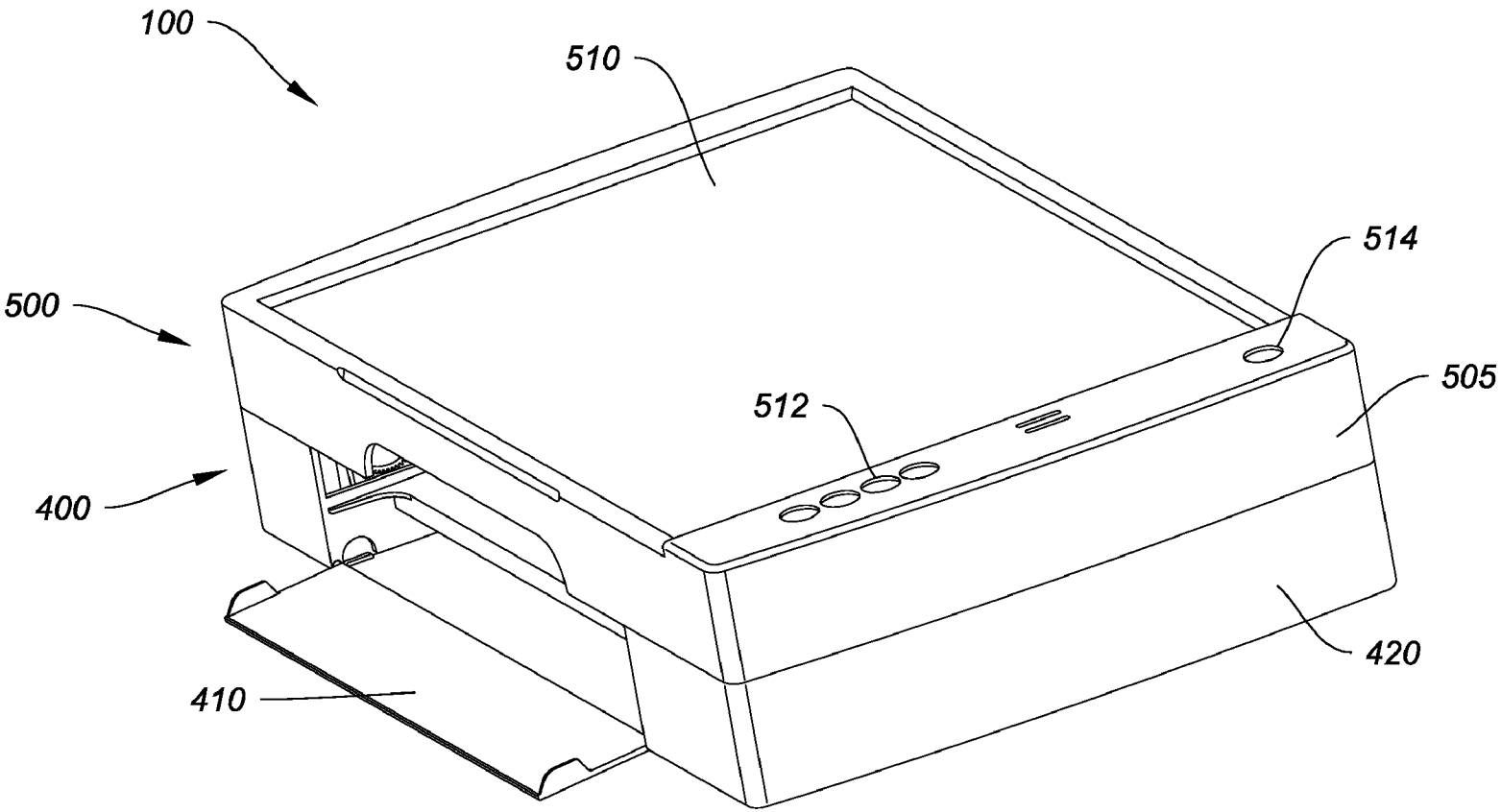
FIG. 2 is a perspective view that shows a multifunction printer according to an embodiment of the present invention.

FIG. 2 is a perspective view that shows a multifunction printer 100 according to an embodiment of the present invention. A scanning apparatus 500 is positioned atop a printing apparatus 400. Scanning apparatus 500 has transparent platen 510, preferably glass, for supporting documents or other items to be scanned in order to convert an image into digitized data. Although the scanning apparatus preferably uses glass as the transparent member, any other suitable transparent member may also be used. An outer case 505 contains the various internal elements of the scanning apparatus 500. Mounted on case 505 are one or more operator controls 512, and optionally one or more indicators 514.

Figure 1:
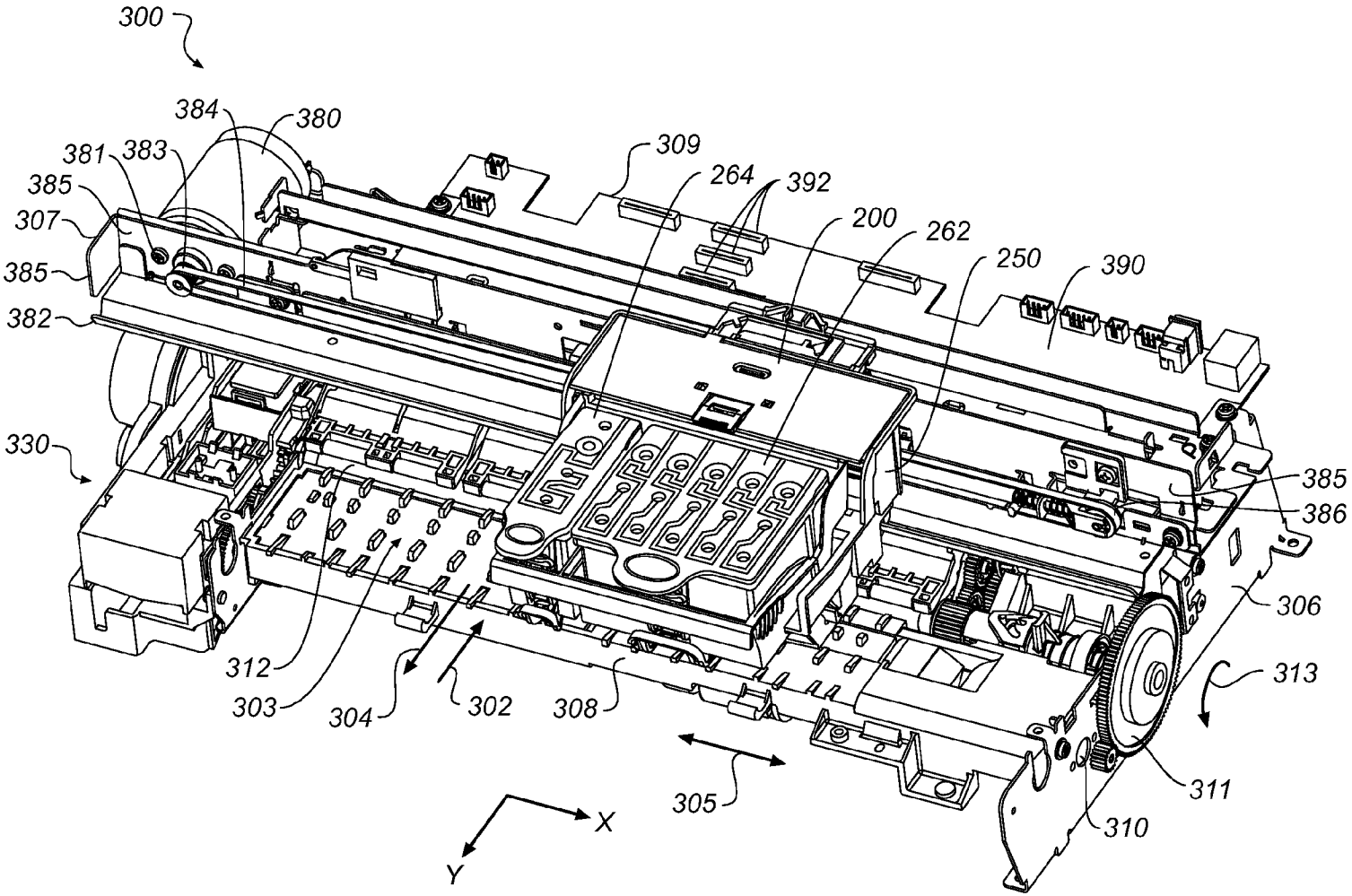
FIG. 1 (PRIOR ART)
FIG. 1 is a perspective view showing components of a prior art carriage printer.

Embodiments of the present invention provide, within multifunction printer 100 (although applicable also in stand-alone printing apparatus architectures as well), a configuration for printing apparatus 400 that is assembled in a different manner from the "backbone"-based construction described previously with reference to FIG. 1. In embodiments of the present invention, a number of structural parts have been eliminated. Functions provided by the backbone in prior art printers, such as providing a support and attachment for motors, rollers, power supplies, carriage guides, and drive shafts, are described in further detail below. Embodiments also address desirable features such as reduced height and reduced noise.

Figure 3:
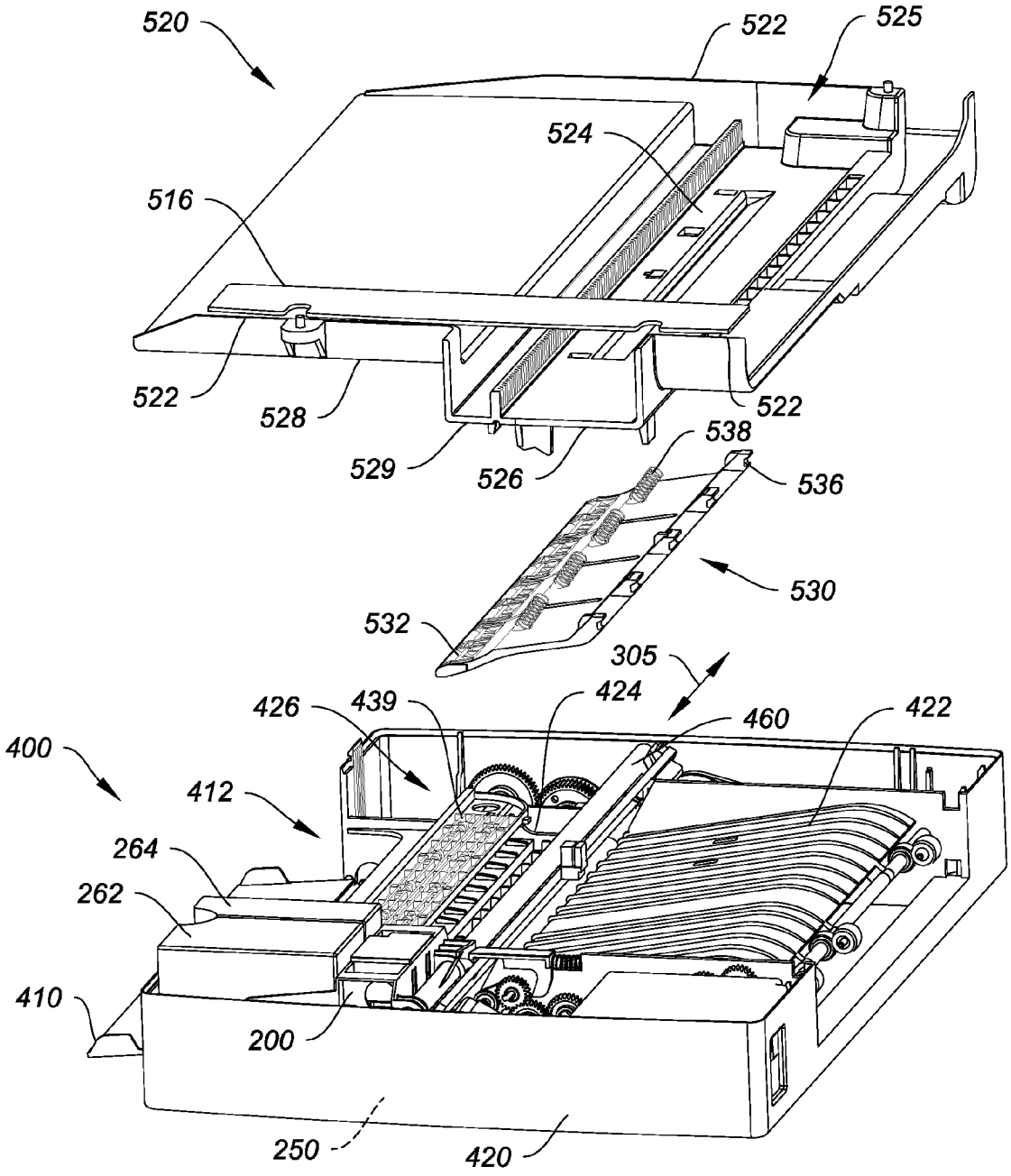
FIG. 3 is a partially exploded view that shows elements of the multifunction printer of FIG. 2.

Referring to the partially exploded view of FIG. 3, the case, the platen glass and most inner components (such as a scan bar and Motor) of scanning apparatus 500 have been hidden, so that scanner base 520 can be seen more clearly. Scanner base 520 is shown removed from its assembled position, fitted against a printer chassis 420. Scanner base 520 can be formed of a single piece of plastic using injection molding, fig example. At its top side it includes supports 522 for platen glass 510 (see FIG. 2). In other words, the top side of scanner base 520 faces platen glass 510. Also seen from the top perspective view of FIG. 3 is the scanner housing 525, which is formed as part of scanner base 520. An element of scanner housing 525 is rack 524 along which a scan bar (not shown) is used to scan documents that are placed on platen glass 510 (see FIG. 2). The bottom of scanner base 520 includes a first region 528 and a second region 529 that extends lower than the first region 528. The second region 529 extends lower in order to provide room for the rack 524 and the associated motor and gear of the scan bar (not shown). Even though ink supplies 262 and 264 (seen in the lower portion of FIG. 3) are the most upwardly extending parts of the printing apparatus 400, they are situated in an area corresponding to first region 528 of the bottom of scanner base 520. The circuit board 516 is attached to the scanner base 520 but is not an integral part of the scanner base 520.

A pinch roller assembly 530, shown separately in the exploded view of FIG. 3, is affixed to the bottom of scanner base 520, and extends into the media travel path, downward in the orientation of FIG. 3. Affixing of pinch roller assembly 530 can be done by snap fitting fingers 536 to scanner base 520 and attaching springs 538. Pinch rollers 532 are biased by springs 538 to press against the feed roller to form a nip 533 (see FIG. 6).

Figure 4:
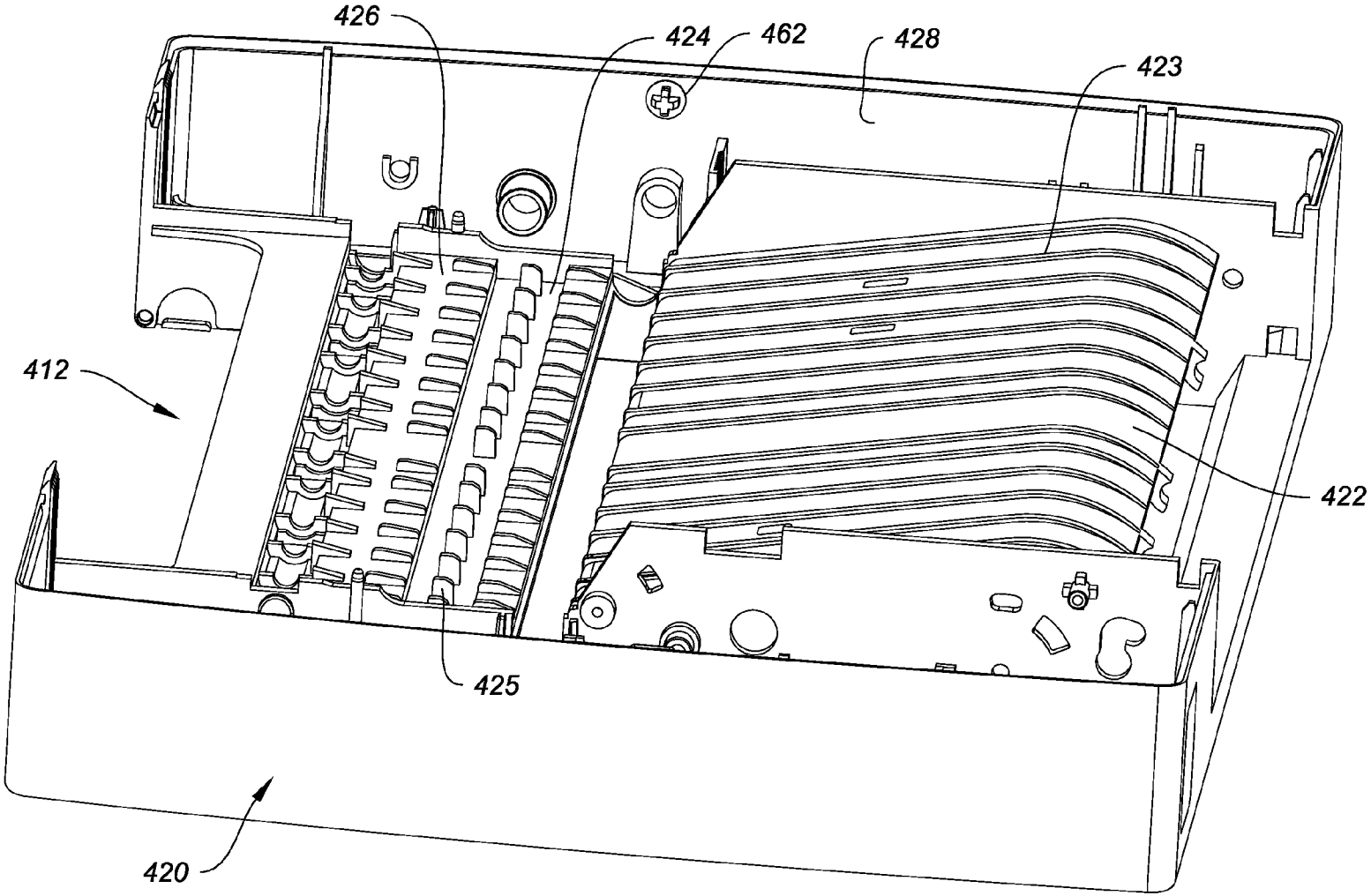
FIG. 4 is a perspective view that shows a printer chassis of FIG. 3.
Figure 5:
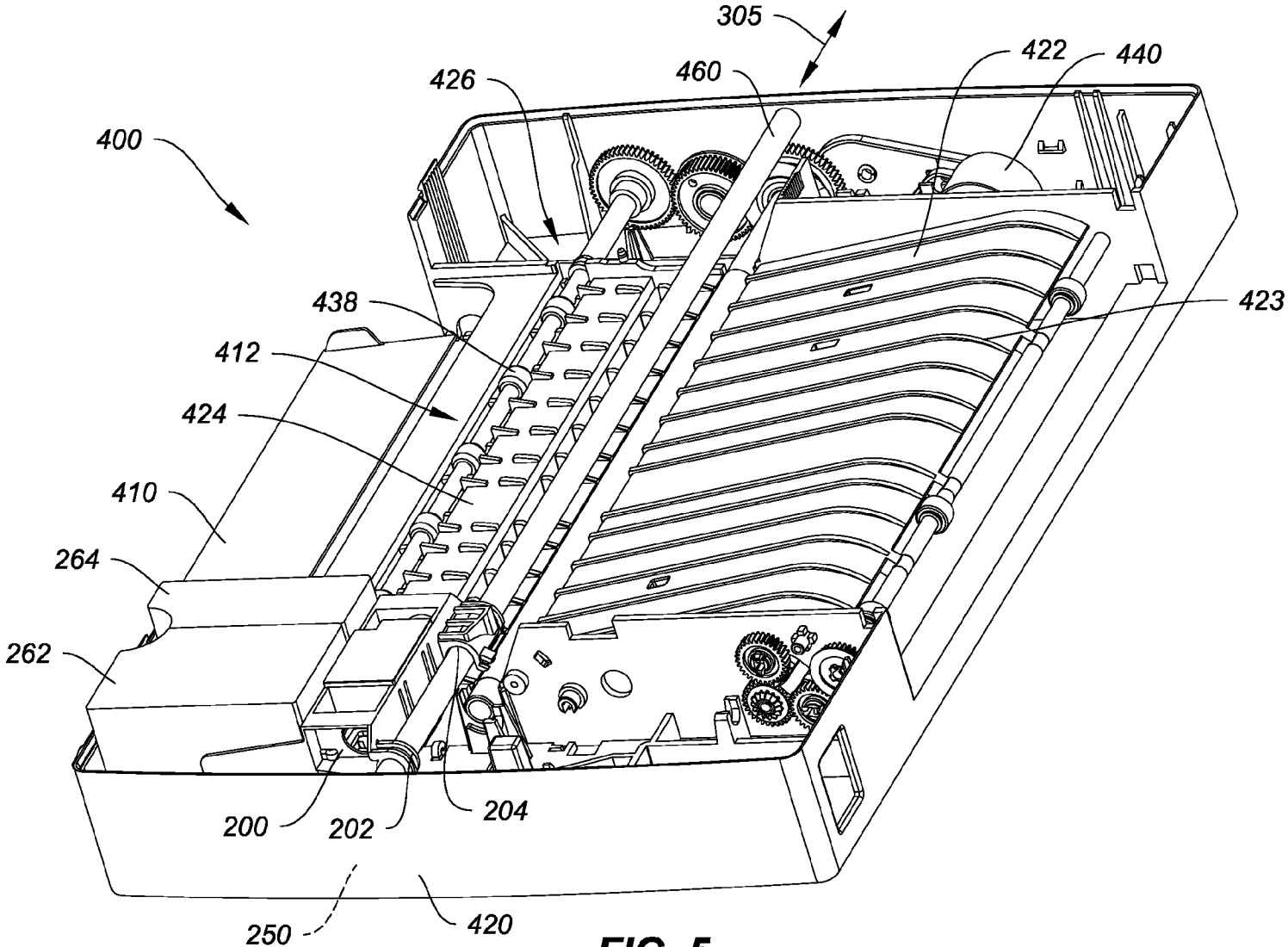
FIG. 5 is a perspective view of the printer chassis of FIG. 4 populated with components.

Some components of printing apparatus 400 are also shown in FIG. 3 and the close-up perspective view of FIG. 5, while the close-up perspective view of FIG. 4 shows the printer chassis 420 in isolation, empty of other components. Printer chassis 420 can be formed of a single piece of plastic using injection molding, for example. Printer chassis 420 includes a media input region 412 near door 410, a media support element 422, a printing region 424, and a discharge region 426. Various rollers are used to move recording medium along a media transport path as is described below relative to FIG. 6. A paper advance motor 440 provides power to rotate the rollers by various belts and gears that are shown in the example of FIG. 5, as discussed in further detail below. Media support element 422 can include a plurality of ribs 423 in order to reduce frictional drag on the moving recording medium. There can also be a plurality of ribs 425 in the printing region 424, as seen most clearly in FIG. 4. Ribs 425 support the paper in the printing region and are positioned to avoid overspray of ink during borderless printing on recording media of standard sizes. A carriage guide 460 is mounted to printer chassis 420 and held in place by retainer 462 on side wall 428 of printer chassis 420 (shown in FIG. 4). A carriage 200 is slidably mounted on carriage guide 460 via carriage bearings 202 and 204, and is configured to move a printhead 250 (hidden behind the wall of printer chassis 420) and its ink supplies 262 and 264 in a carriage scan direction 305 along printing region 424 in order to print an image one swath at a time.

Figure 6:
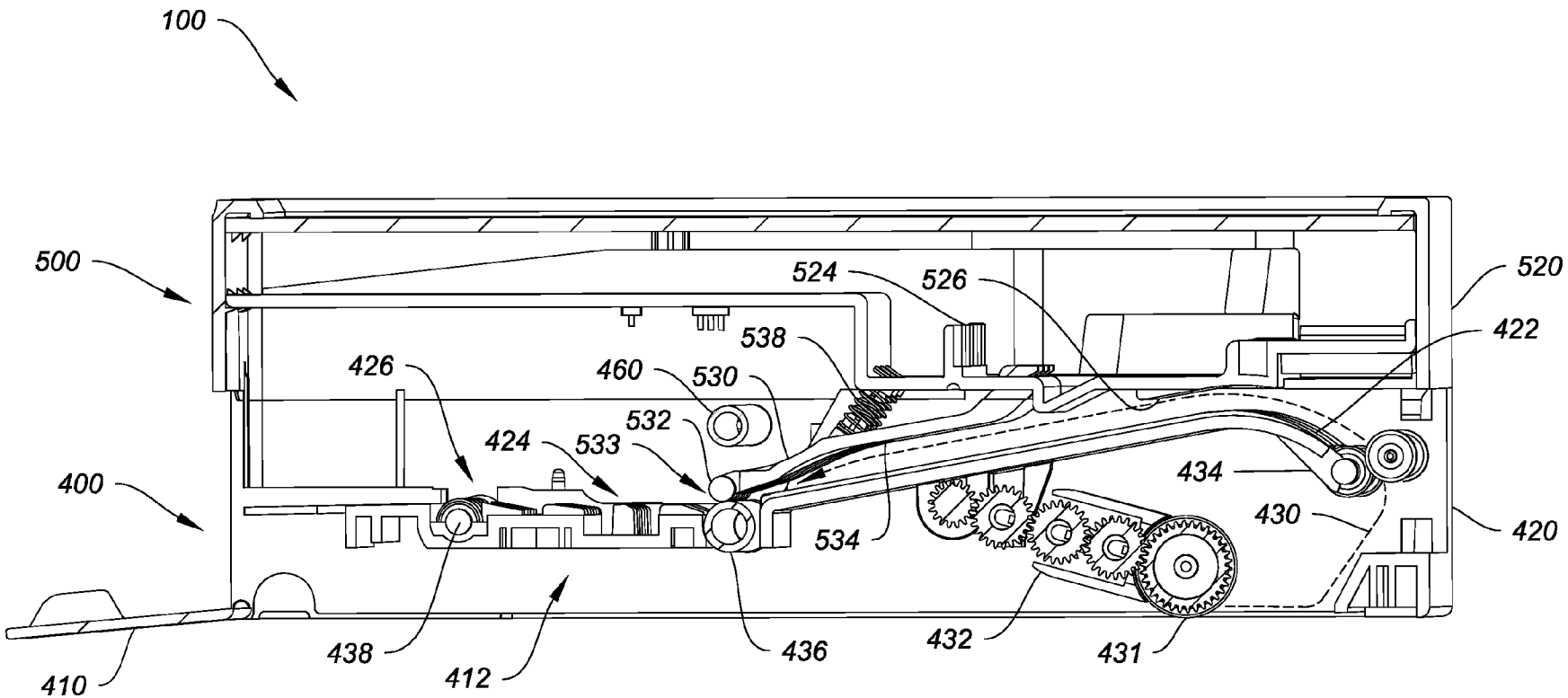
FIG. 6 is a cross-section view of the multifunction printer of FIG. 2 that shows the media transport path for the printing apparatus.

FIG. 6 shows a cross-sectional view of the multifunctional printer of FIG. 2. During printing, recording medium (not shown) is moved along a media transport path 430 (indicated as a dashed line) from media input region 412, across the media support element 422, then to the printing region 424, and finally to the discharge region 426. In particular, a pick roller 431 on pick arm 432 moves the recording medium from media input region 412 toward turn rollers 434 located in a turn region and to the media support element 422 that is located above media input region 412 when the multifunction printer 100 is oriented in its operating position. (A cleanout element that provides a curved guide surface to guide the recording medium upward from the pick roller 431 to the turn rollers 434 is not shown.) After the recording medium passes the turn rollers 434, the tendency of the recording medium to remain substantially straight causes the recording medium to contact the bottom of scanner base 520. In other words, the bottom surface 526 of scanner base 520, located above media support element 422, provides an upper guide for the recording medium as it passes through this region. As the recording medium continues to advance along media transport path 430, it passes below pinch roller assembly 530. In other words, the bottom surface 534 of pinch roller assembly 530, as well as the top of media support element 422, act as guides for the recording medium as it passes through this region. The recording medium is thus guided into the nip 533 formed by pinch rollers 532 that are biased by springs 538 against rotating feed roller 436, to move the recording medium across printing region 424 and over to discharge region 426. A discharge roller 438 (seen in FIGS. 5 and 6) drives the recording medium toward door 410. A star wheel assembly 439 (seen in FIG. 3) positioned over the discharge roller pushes the paper into the discharge roller without smearing the ink on the freshly printed recording medium.

Figure 7:
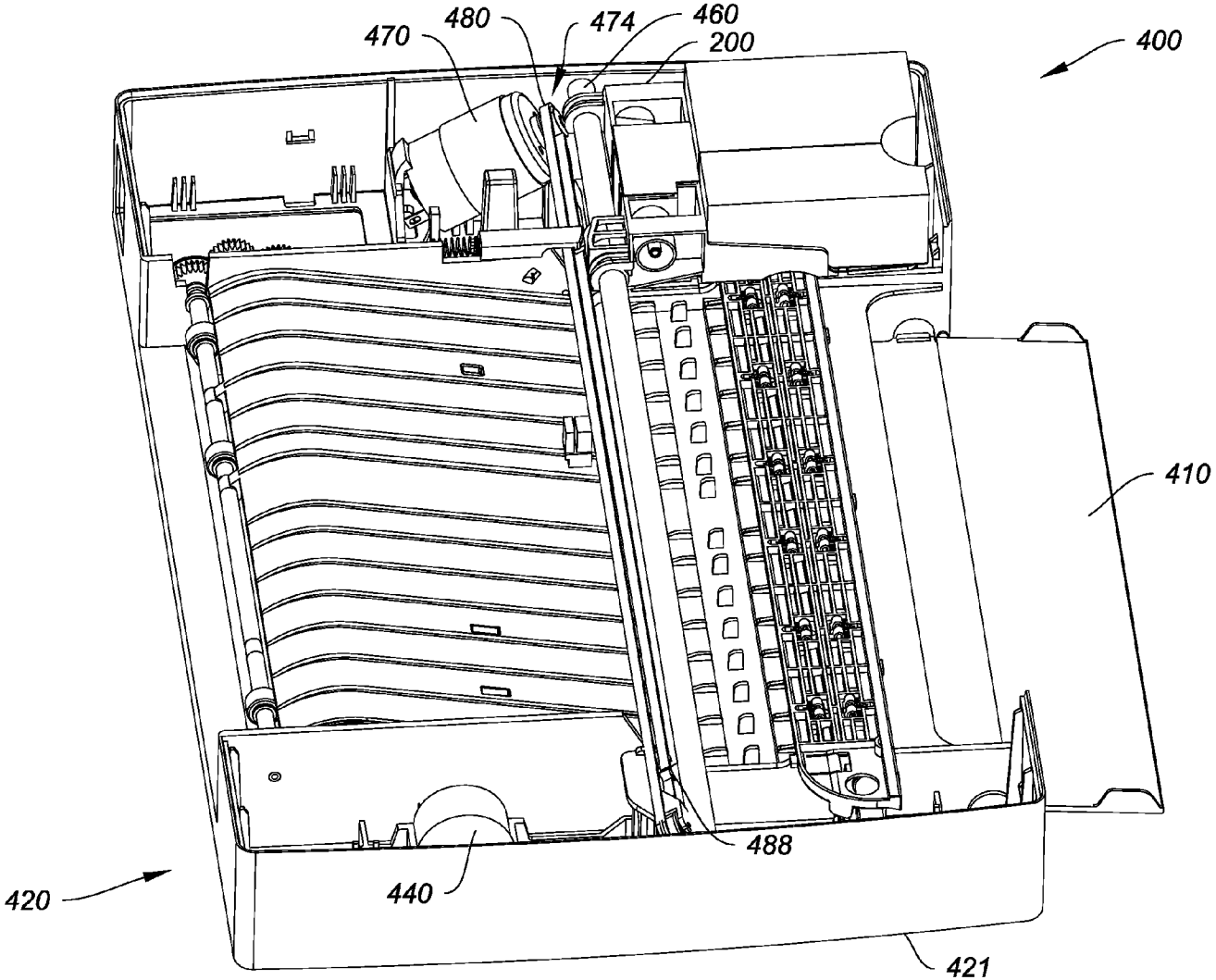
FIG. 7 is a perspective view of a printing apparatus having an inclined carriage motor according to an embodiment of the invention.

FIG. 7 is a perspective view of printing apparatus 400, and shows printer chassis 420 populated with a number of the printer components (including carriage 200, carriage guide 460, carriage motor 470, belt 480, and paper advance motor 440), but rotated with respect to the views shown in FIGS. 3 and 5, such that the door 410 is to the right. In this view, carriage motor 470 is shown mounted in an inclined orientation-relative to base 421 of printer chassis 420, according to an embodiment of the invention. Since the nominal operating position of printing apparatus 400 is such that the base 421 of printer chassis 420 rests in a substantially horizontal plane, it can also be said that carriage motor 470 is inclined with respect to a horizontal plane when the printing apparatus 400 is in its nominal operating position. Belt 480 is looped around rotatable motor axle 474 of carriage motor 470 near one end of carriage guide 460 and around idler pulley 488 (see also FIG. 16) near the opposite end of carriage guide element 460. Idler pulley 488 includes an axis of rotation that is configured to be parallel to the rotatable axle 474 of carriage motor 470.

Figure 8:
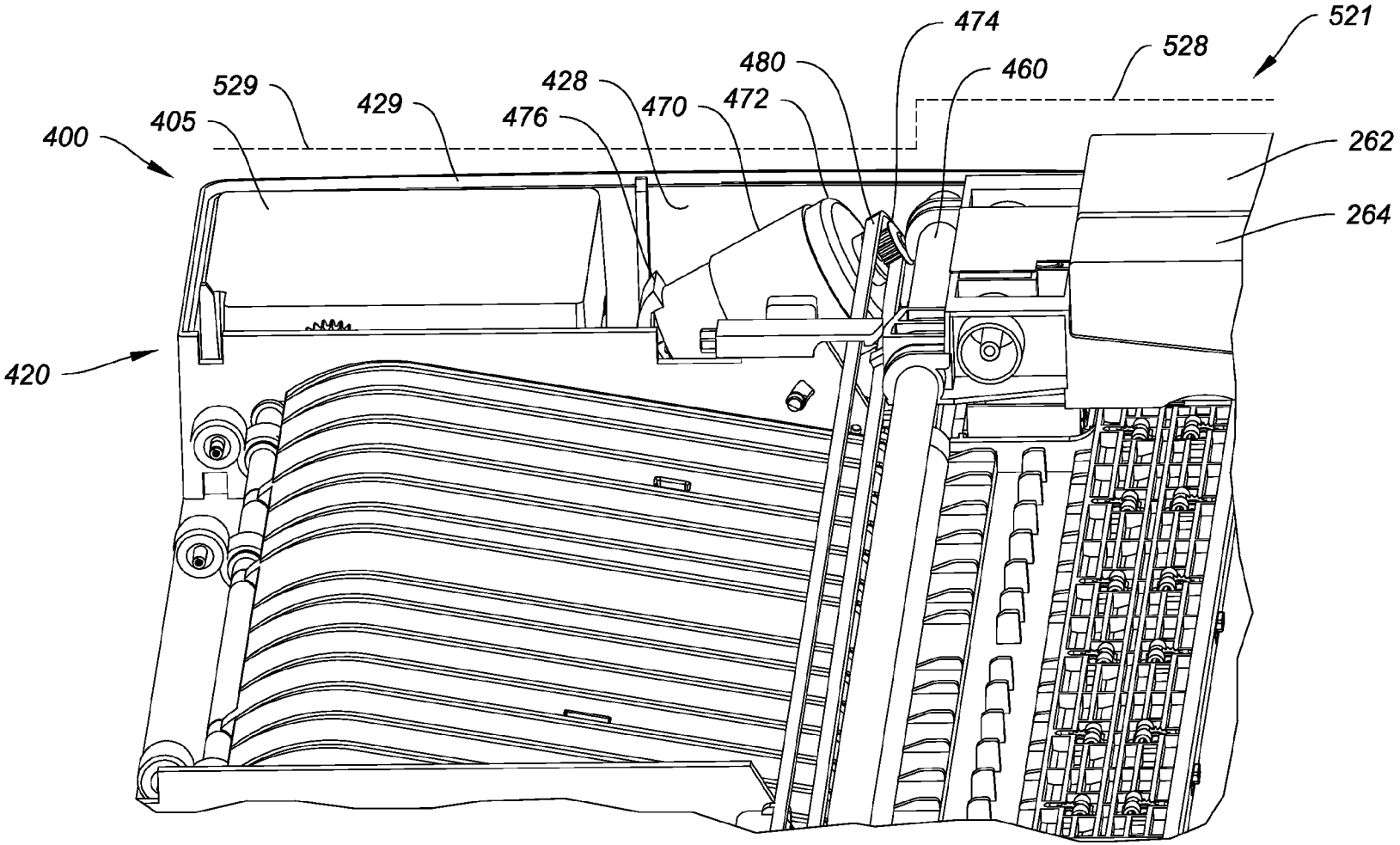
FIG. 8 is a close-up view of a portion of the printing-apparatus of FIG. 7.

FIG. 8 is a close-up perspective view of a portion of printing apparatus 400 together with a dashed line 521 that approximately represents the contour of the bottom of scanner base 520. As discussed relative to FIG. 3, scanner base 520 includes a first region 528 and a second region 529 that extends lower than first region 528. As seen in FIG. 8, carriage motor 470 is located near the second region 529 of the bottom of scanner base 520. If carriage motor 470 were horizontally mounted (as in prior art FIG. 1), its outer casing would interfere with the second region 529 of the bottom of scanner base 520. In order to reduce the height of printing apparatus 400 (and therefore the height of multifunction printer 100), in the embodiment shown in FIG. 8, carriage motor 470 is mounted to be inclined relative to horizontal base 421 (see FIG. 7). The upper edge 472 of carriage motor 470 is thus able to be about the same height as the upper rim 429 of the side wall 428 of printer chassis, and not interfere with the second region 529 of the bottom of scanner base 520. In addition, in order to keep carriage vibrations at a low level, motor axle 474, and belt 480 are substantially radially oriented relative to the lengthwise axis of carriage guide 460, as shown in further detail below relative to FIG. 9. Carriage motor 470 is held in printer Chassis 420 by inclined cradle 475 (see FIG. 10) that is molded as part of printer chassis 420. A holding feature 476 of inclined cradle 475 is shown in FIG. 8. Also shown in FIG. 8 is power supply 405 having a height that positions the top edge of power supply 405 near the upper rim 429 of side wall 428.

Figure 9:
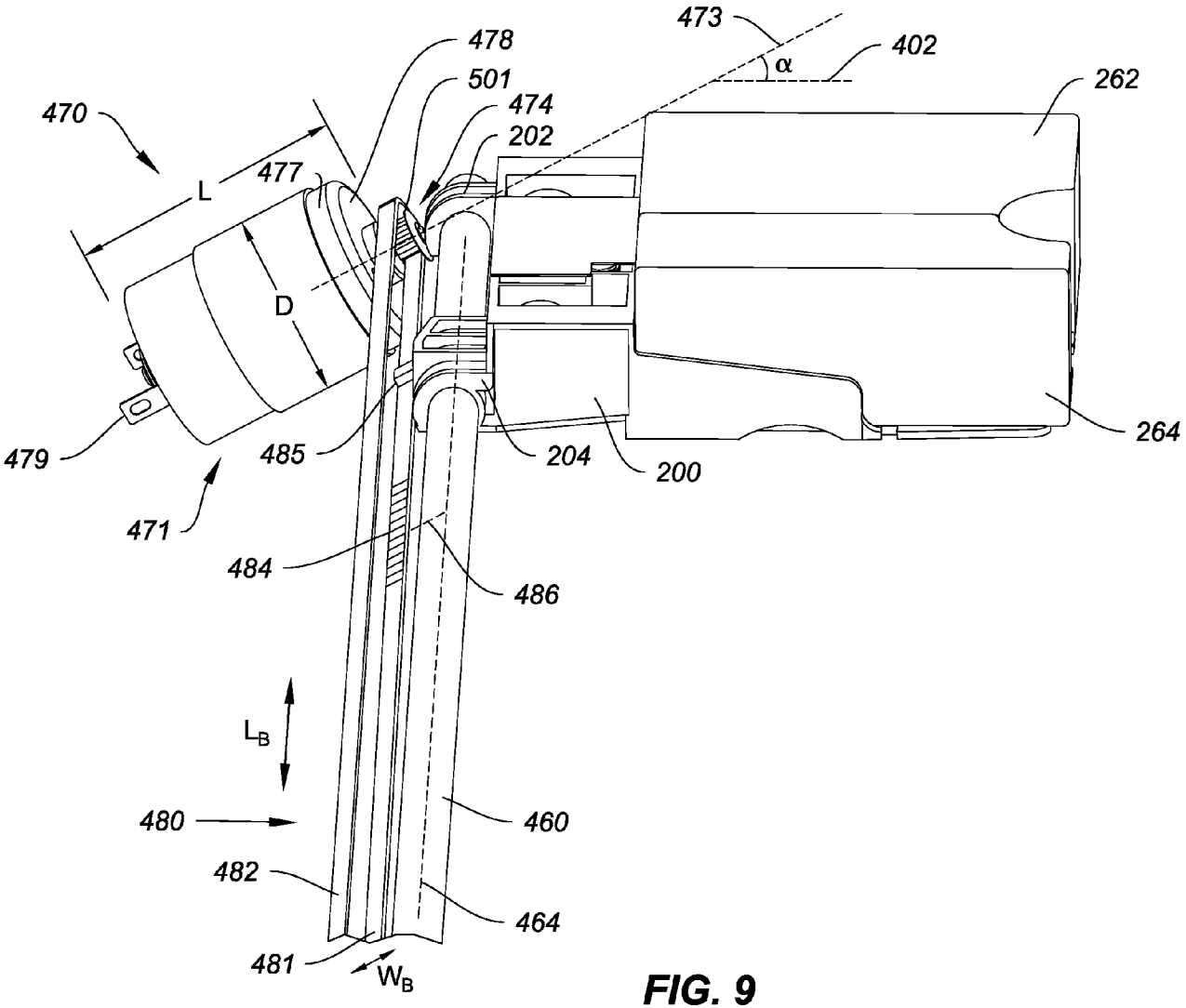
FIG. 9 is an even closer view of the inclined motor of FIG. 7 and associated components.

FIG. 9 shows a close-up perspective view of some of the components of printing apparatus 400 at approximately the same viewing angle as FIG. 8, but with printer chassis 420 hidden for clarity. Carriage 200 includes carriage bearings 202 and 204 that glide along carriage guide 460. Carriage motor 470 has an outer casing 471 including a cylindrical wall 477 that is substantially coaxial with rotatable motor axle 474 and a face 478 that is substantially perpendicular to rotatable motor axle 474. Outer casing 471 has a length L and a diameter D. In this example L is greater than D. As described above the diameter of the motor is sufficiently large that cylindrical wall 477 would interfere with second region 529 of scanner base 520 if the carriage motor were horizontally mounted. In addition, because the length L of the outer casing of carriage motor 470 is larger than its diameter D (not even counting the added length of the motor axle 474 and the electrical terminal (s) 479, mounting the carriage motor 470 with axis 473 of rotatable motor axle 474 pointing vertically upward would also cause interferences with the second region 529 of scanner base 520 (see FIG. 8). In other words, mounting the carriage motor 470 either horizontally or vertically would increase the height of printing apparatus 400 relative to the inclined orientation of the present invention. The preferred angle $\alpha$ of inclination of rotatable motor axle 474 from a line 402 that is parallel to the base 421 (see FIG. 7) depends on the overall length of carriage motor 470, the diameter of its outer casing 471, the position of belt attachment, etc. In the example shown in FIG. 9; the angle $\alpha$ of inclination of rotatable motor axle 474 from a line 402 that is parallel to the base 421 (i.e. the angle of inclination between rotatable motor axle 474 and a horizontal plane when the printing apparatus is in its nominal operating position) is about 30 degrees. In general the preferred angle $\alpha$ of inclination is between ten degrees and eighty degrees, and more preferably between twenty degrees and fitly degrees.

Motor axle 474 typically includes a toothed pulley having an outer rim 501 to keep the belt 480 engaged. Herein the term motor axle will also include the motor pulley. Belt 480 includes a first section 481 on one side of motor axle 474 and a second section 482 (substantially parallel to first section 481) on the other side of motor axle 474. In the example shown in FIG. 9, belt attachment 485 is on the first section 481. As the carriage 200 moves back and forth along carriage guide 460, different parts of belt 480 will be above or below motor axle 474. However, even at the extreme ends of travel of carriage 200, belt attachment 485 will not move from one side of motor axle 474 to the other side. Thus, the portion of first section 481 that includes belt attachment 485 is always on a predetermined side of motor axle 474, even if portions of the belt 480 move from one side of the motor axle 474 to the other side. Belt 480 includes a length direction $L_B$ extending from the rotatable motor axle 474 to the idler pulley 488 (see FIG. 7), and a width direction W, extending substantially parallel to the rotatable motor axle 474. In order to keep carriage vibration at a low level, the width direction $W_B$ of belt 480 is disposed in a substantially radial orientation relative to an axis 464 of the carriage guide 460. This can be seen more clearly FIG. 9 relative to teeth 484 (a few of which are shown on the inner surface of the first section 481 of belt 480). Radial line 486 from carriage guide axis 464 extends along substantially the same direction as teeth 484, i.e. the teeth 484 on the first section 481 of belt 480 are oriented substantially radially relative to axis 464 of carriage guide 460. It can also be seen in FIG. 9 that first section 481 of belt 480 is positioned at a first distance from carriage guide 460, and section 482 is positioned at a second distance from carriage guide 460, where the first distance is less than the second distance.

Figure 10:
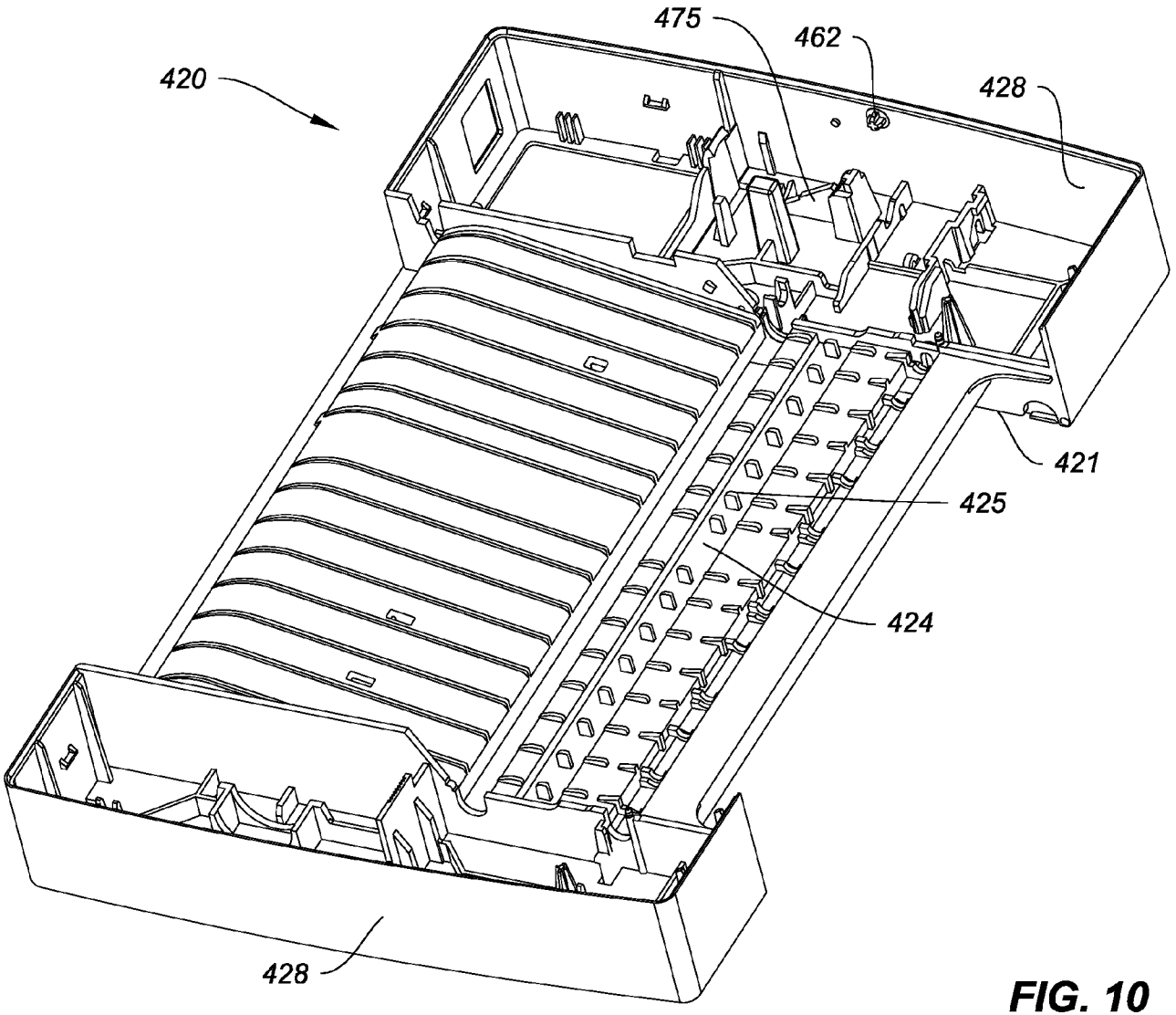
FIG. 10 is a perspective view of the printer chassis of the printing apparatus of FIG. 7.

FIG. 10 shows a perspective view of printer chassis 420 looking toward the region where the carriage motor would be mounted, but with no printer components assembled onto printer chassis 420. Inclined cradle 475 for supporting carriage motor 470 at an inclined orientation relative to base 421 of printer chassis 420 can be seen. Also visible in FIG. 10 is retainer 462 (opposite the retainer 462 seen in FIG. 4) for holding carriage guide 460 in place. Ribs 425 for supporting recording medium in printing region 424 are also seen.

Figure 11:
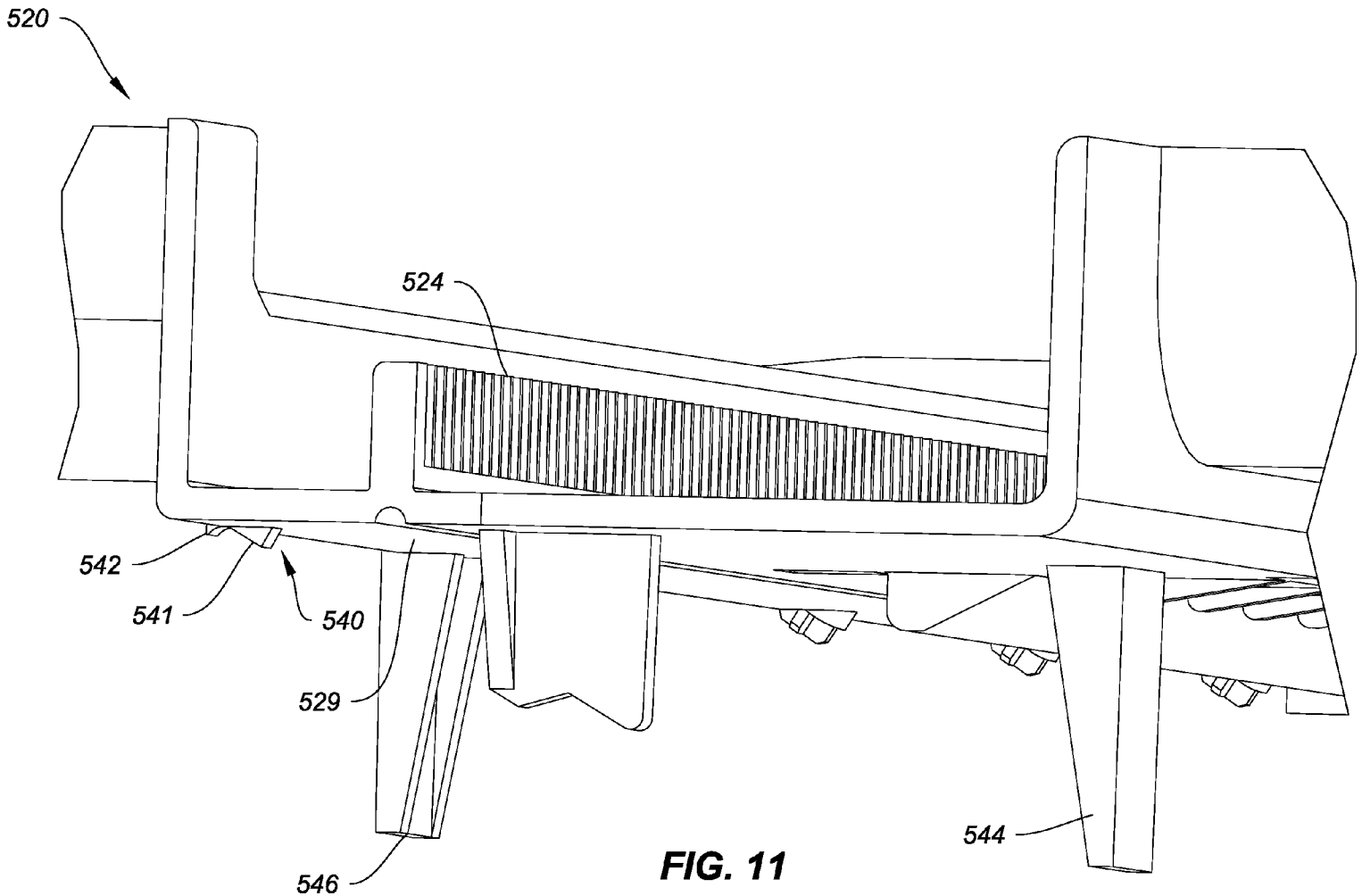
FIG. 11 is a close-up underside perspective view of a portion of the scanning apparatus of the multifunction printer of FIG. 2 including various features for securing components of the printing apparatus in position.

Inclined cradle 475 and holding feature 476 (see FIG. 8) perform part of the function of holding carriage motor 480 in place in printer chassis 420 using only parts that are molded together with printer chassis 420 and not requiring a separate support structure such as a backbone. In order to further secure the carriage motor 470 in its inclined position, a motor holding feature 540 is provided in second region 529 of the bottom of scanner base 520 as shown in FIG. 11. (The viewing angle of FIG. 11 is rotated with respect to the view of FIGS. 8 and 9.) During the assembly of multifunction printer 100, when scanner base 520 is mounted as an upper structure onto printer chassis 520, motor holding feature 540 engages carriage motor 470 near the upper edge 472 of carriage motor 470 (see FIG. 8) to hold carriage motor 480 against the inclined cradle 475 (see FIG. 10) and holding feature 476 (see FIG. 8) that serve as a motor support in printer chassis 420. In this embodiment, a first portion 541 of motor holding feature 540 contacts cylindrical wall 478 of outer casing 471 of carriage motor 480, and a second portion 542 of holding feature 540 contacts face 477 of outer casing 471 of carriage motor 480.

When the multifunction printer 100 is fully assembled (see FIG. 2), the upper edge 472 of inclined carriage motor 480 is positioned near the base 520 of scanning apparatus 500, so that the overall height of multifunction printer 100 can be reduced relative to conventional multifunction printers. Additionally, the first section 481 that includes belt attachment 485 is oriented substantially radially relative to the carriage guide in order to keep carriage vibrations low for good print quality. Because inclined cradle 475 and holding feature 476 are integrally formed together with printer chassis 420 (e.g. during injection molding), and because motor holding feature 540 is likewise integrally formed with scanner base 520, no additional fasteners or assembled support structures are required, thereby simplifying assembly and reducing cost.

In other embodiments, the general approach of assembling a multifunction printer employed for the carriage motor is also used for assembling a variety of other components of the printing apparatus without using additional fasteners. For these embodiments, the printing apparatus 400 (for printing on recording medium) is provided that includes a printer chassis 420 having a support feature (such as inclined cradle 475 and holding feature 476) for holding a component of the printing apparatus. The component (such as carriage motor 470) is mounted onto the support feature. A scanning apparatus 500 (for convening an image into digitized data) is provided that includes a securing feature (such as motor holding feature 540 on scanner base 520). The scanning apparatus is then affixed to printer chassis 420 such that the securing feature of the scanning apparatus constrains a position of the component of the printing apparatus relative to the support feature of the printer chassis. In some instances, such as for the carriage motor, the securing feature can actually contact the component in order to hold it fixedly in place. For example, scanner base 520 can have a securing feature extending from scanner base 520 to contact power supply 405 (see FIG. 8) in order to hold it in place when scanner base 520 is assembled onto printer chassis 420. In other instances, the securing feature allows rotational motion of the component, but constrains translational motion. In some instances the securing feature of scanning apparatus 500 is brought nearly into contact, but not actually into contact with the component, so that an acceptable amount of motion of the component is allowed, but not an excessive amount of motion.

Figure 12:
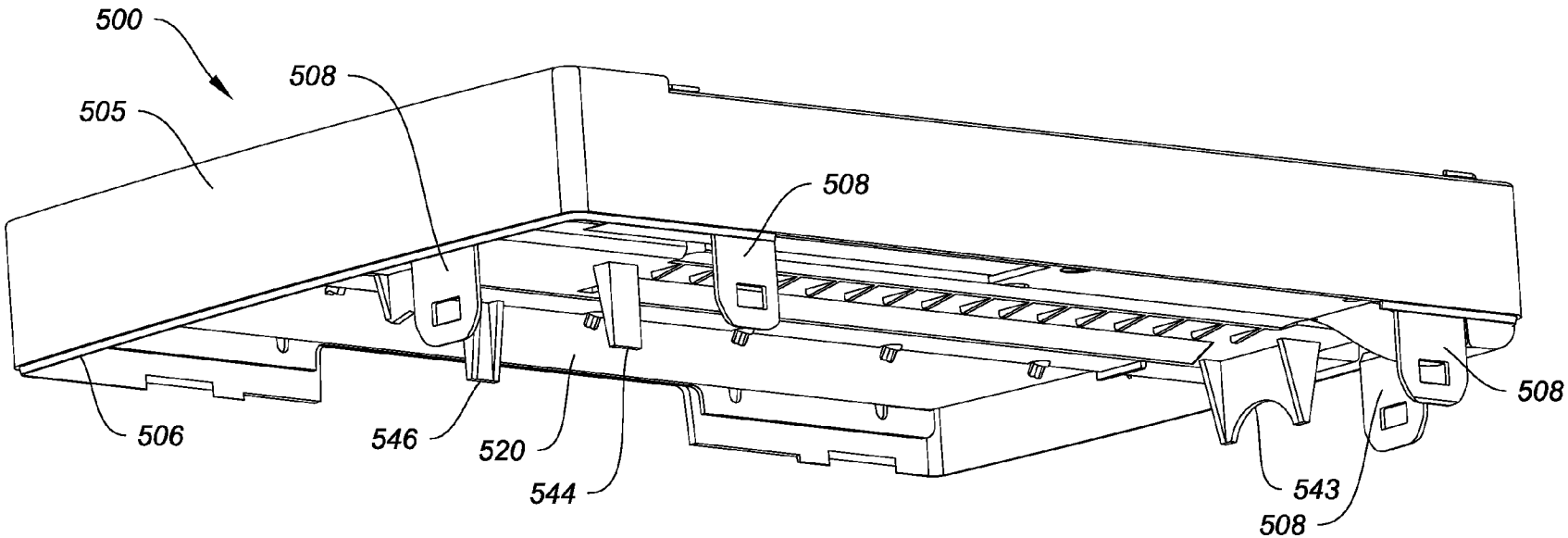
FIG. 12 is an underside perspective view of a the scanning apparatus of the multifunction printer of FIG. 2.

Assembly of carriage guide 460 is another example of this assembly approach that is used in some embodiments. In FIGS. 4 and 10, retainer features 462 (serving as support features for carriage guide 460) are shown on opposing side walls 428 of printer chassis 420. One or both of the opposing side walls 428 are somewhat flexible, so that at least the top portion of a side wall 428 can be bent outward, away from the inner region of the printer chassis 420. In the examples shown in FIGS. 4 and 10, retainer features 462 extend inwardly into printer chassis 420. Carriage guide 460 (see FIG. 5) is provided with open ends 461 (see FIG. 16) that can fit onto retainer features 462. When flexible side walls 428 are not bent, carriage guide 460 is longer than the distance between a predetermined distance between the retainer features 462. By bending at least one of the flexible side walls 428 in an outward direction such that a distance between the two retainer features 462 is longer than the length of the carriage guide element, a first retainer feature 462 can be inserted into one open end 461 of the carriage guide, and the second retainer feature 462 can be inserted into the second open end 461 of the carriage guide. When the flexible side walls 428 are released, retaining features 462 hold carriage guide 460 in its mounted position in printer chassis 420. Interlocking features, such as attachment tabs 508 can be provided on outer case 505 of scanning apparatus 500, as shown in FIG. 12 to reduce the flexibility of the opposing flexible side walls 428 of printer chassis 420, so that when scanning apparatus 500 is affixed to printer chassis 420, carriage guide 460 becomes further secured with its position constrained. Lower rim 506 of outer case 505 can also engage with upper rim 429 (see FIG. 8) of side wall 428 of printer chassis 420 when scanning apparatus 500 is affixed to printer chassis 420. Interlocking complementary lips on upper rim 429 of side wall 428 and on lower rim 506 of outer case 505 can further reduce the flexibility of side walls 428 when the scanning apparatus 500 is affixed to printer chassis 420. Interlocking tongue and groove features (not shown) can also be provided. Such interlocking features—attachment tabs 508 and their attachment points (not shown) on printer chassis 420, complementary lips on upper rim 429 and lower rim 506, and interlocking tongue and groove features include both attachment features in the scanning apparatus 500 and mating features 420 that reduce the flexibility of the flexible side walls 428 when scanning apparatus 500 is affixed to printer chassis 420.

In addition to reducing the number of fasteners and not requiring an additional assembled structure, such as a backbone, a further advantage of attaching the carriage guide 460 to retaining features 462 that have been integrally formed with printer chassis 420 is improved dimensional tolerances. In particular, the distance from the printhead face to the recording medium in the printing region 424 is critically important. If this distance is too large, poorly performing jets that eject drops at an angle relative to their intended direction result in poor print quality. If the distance is too small, the printhead can strike the recording medium as the printhead is moved back and forth by the carriage, doing damage to both the recording medium, and the printhead. By integrally forming retaining features 462 and ribs 425 in printing region 424 (see FIGS. 4 and 10), for example during injection molding of printer chassis 420, the spacing between printhead and recording medium is thereby well controlled.

Figure 13:
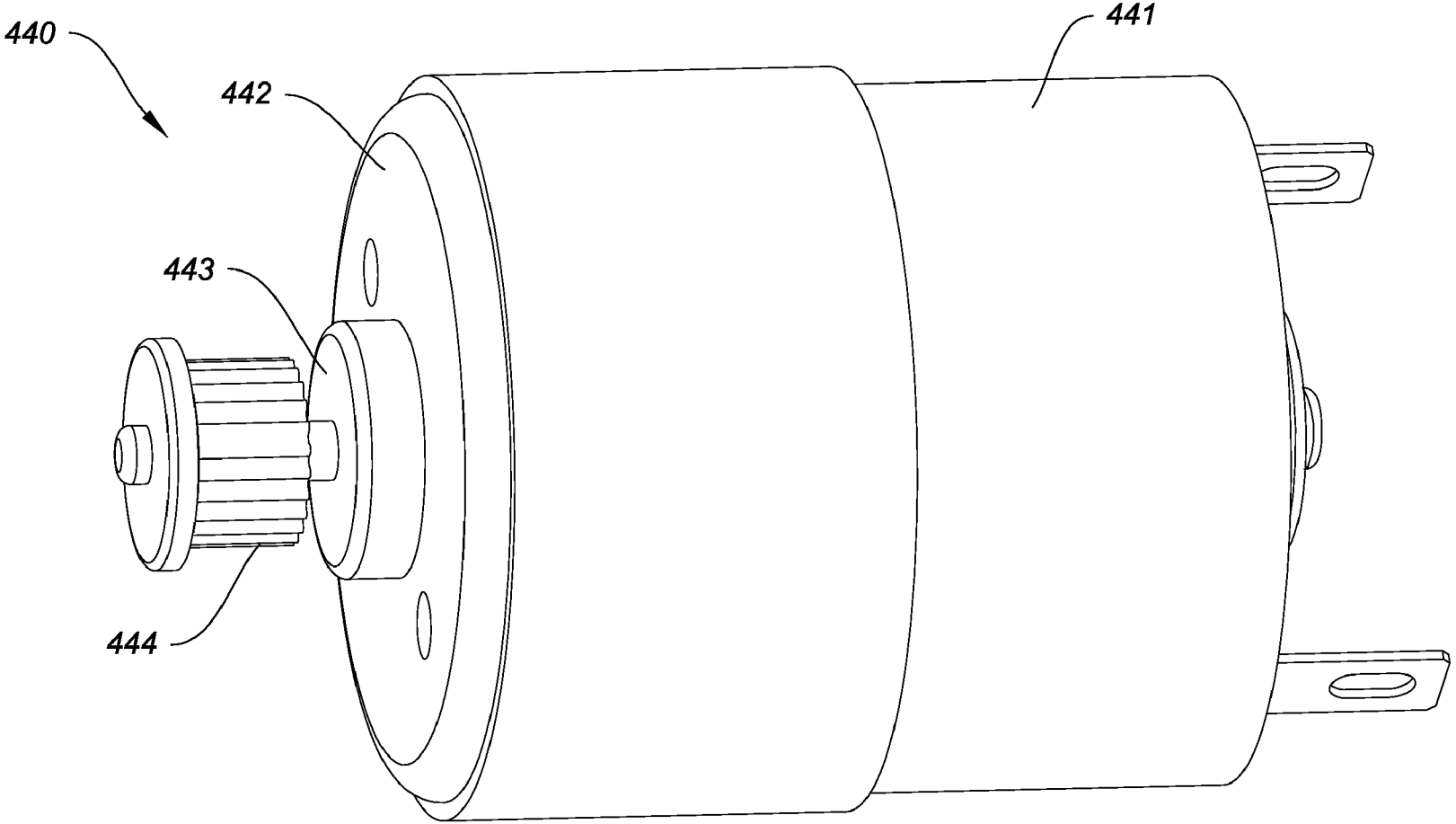
FIG. 13 is a perspective view of a paper advance motor.
Figure 14:
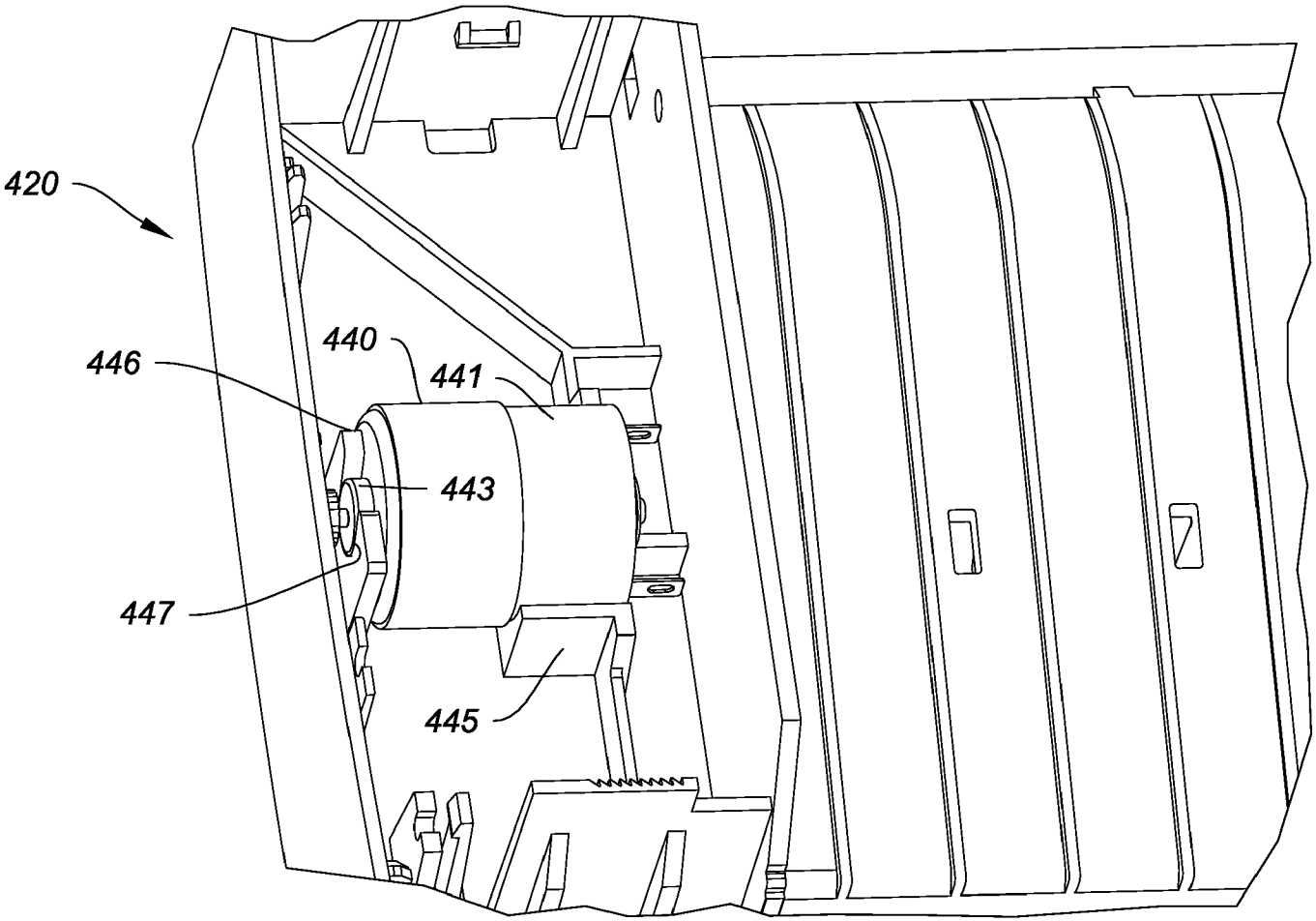
FIG. 14 is a perspective view of a paper advance motor assembled into the printer chassis according to an embodiment of the invention.
Figure 15:
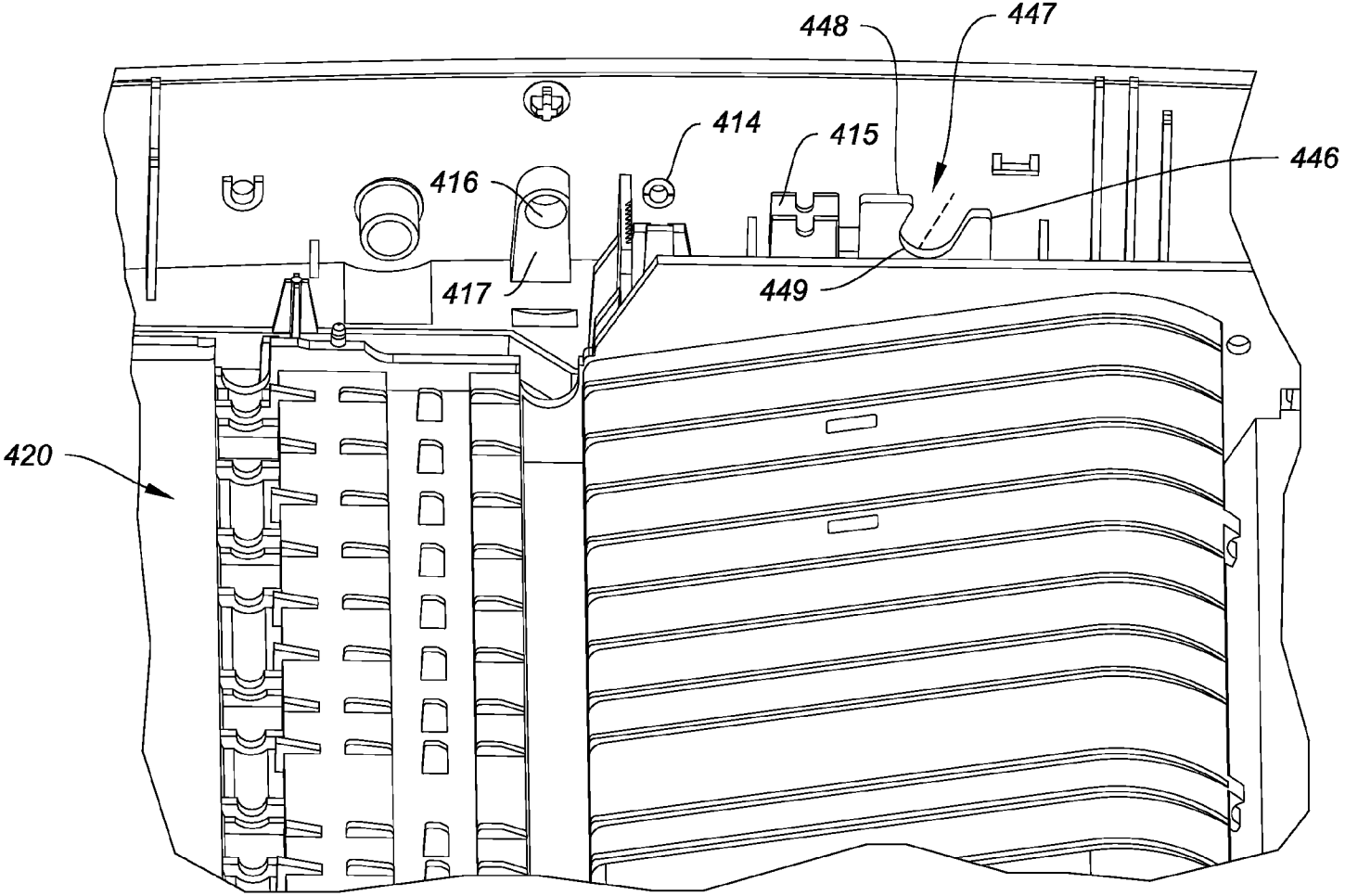
FIG. 15 is a perspective view of mounting features in the printer chassis for mounting the paper advance motor according to an embodiment of the invention.
Figure 16:
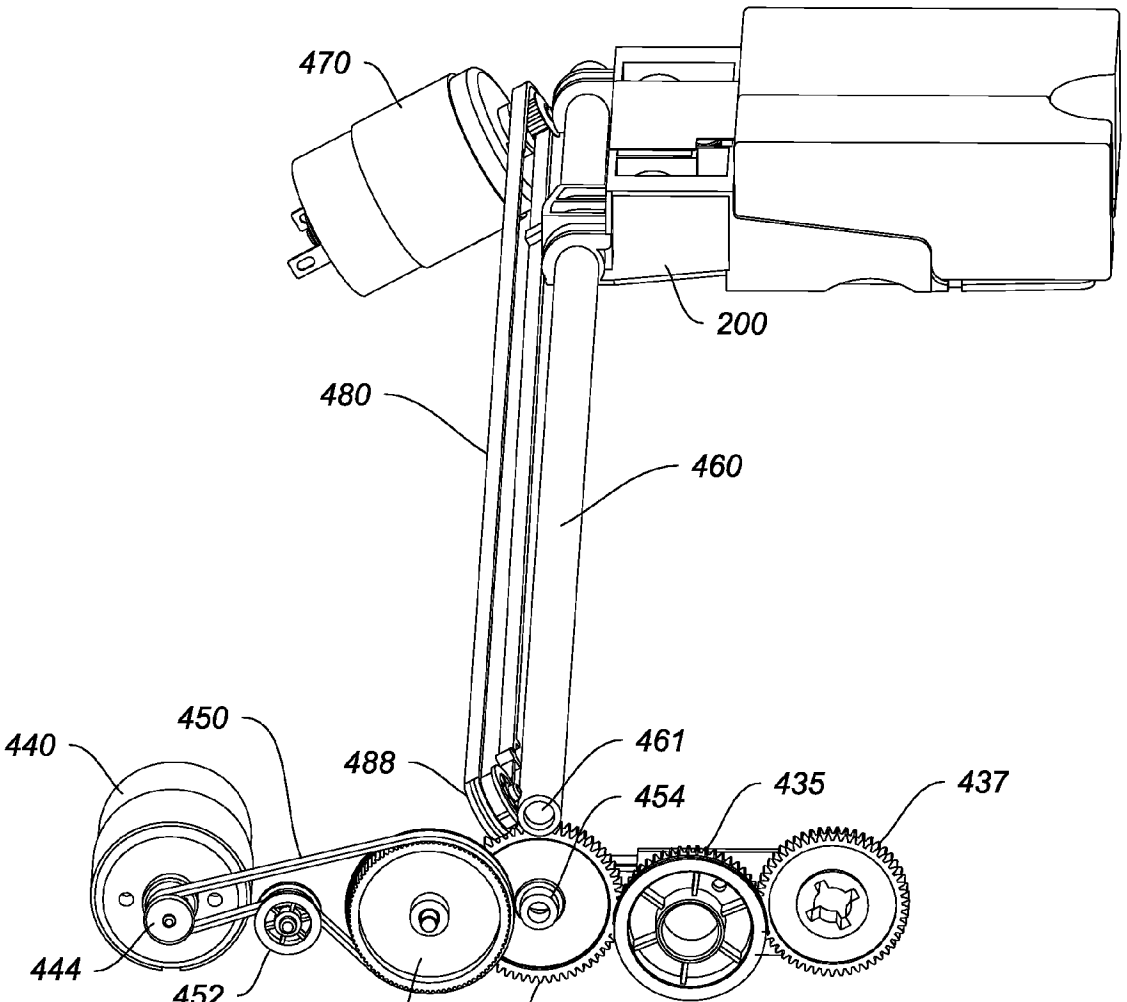
FIG. 16 is a perspective view of the paper advance motor, the inclined carriage motor and several of their associated components.
Figure 17:
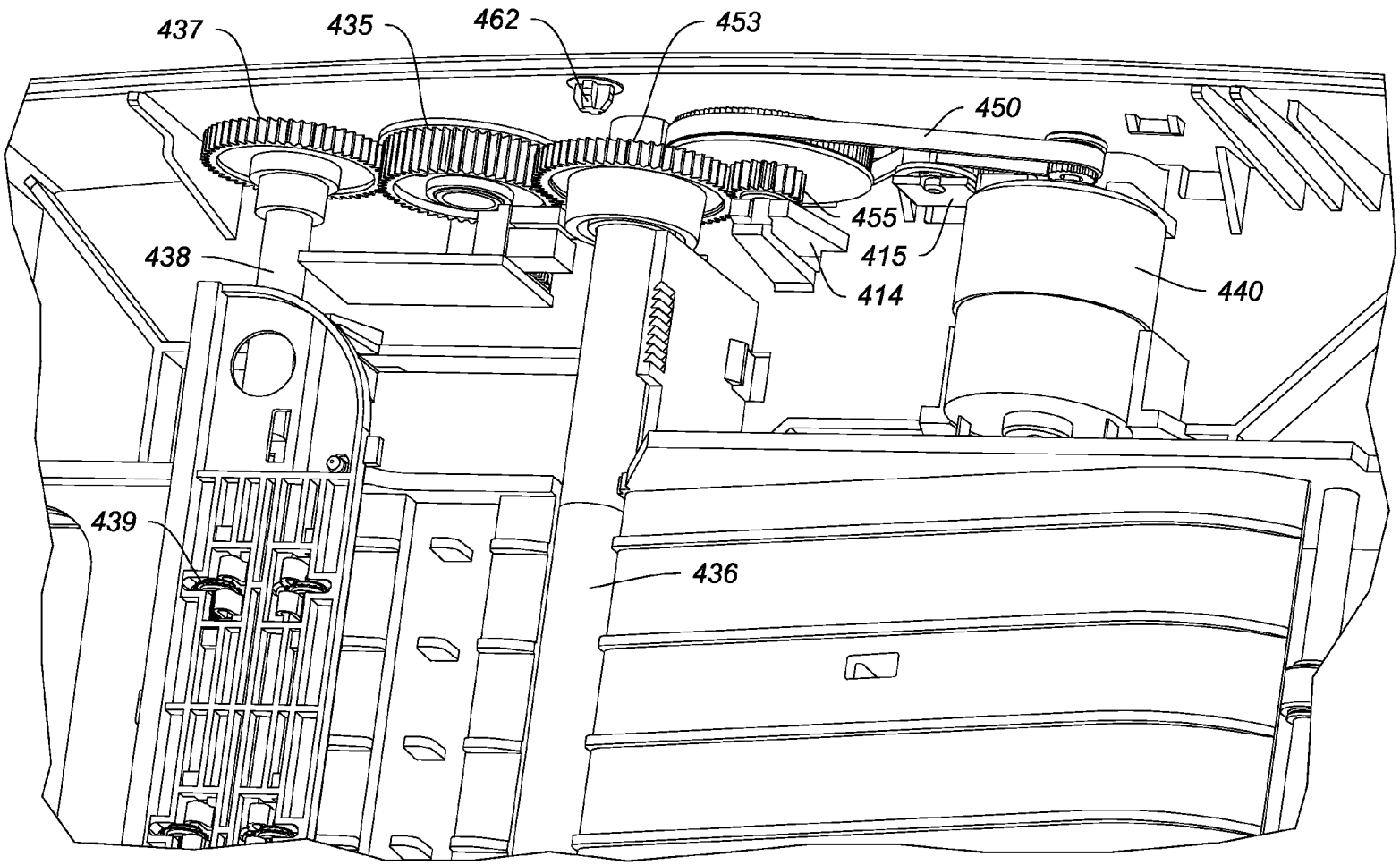
FIG. 17 is a perspective view looking downward toward the paper advance motor and its associated components mounted in the printer chassis.

Paper advance motor 440 is another example of a component that can be assembled onto support features in the printer chassis 420 and then secured in place when the scanning apparatus 500 of multifunction printer 100 is affixed to the printer chassis 420. As shown in FIG. 13, paper advance motor 440 includes a cylindrical wall 441 and a face 442 from which rotatable motor axle 444 extends. Motor axle 444 can include a toothed pulley having an outer rim (unlabelled) for embodiments where a toothed belt is used to transmit power from paper advance motor 440. Also extending from face 442 is a nonrotatable collar 443. Although bolt holes (unlabelled) are provided in the face 442 of a conventional paper advance motor 440 for attachment to a structural framework (as discussed in the background relative to prior art FIG. 1), attachment of paper advance motor 440 in embodiments of the invention does not require additional fasteners or separately assembled framework. As shown in the perspective view in FIG. 14, a cradle 445 and a collar holder 446 are integrally formed as part of printer chassis 420 (e.g. during injection molding of the printer chassis) as support features for paper advance motor 440. Collar holder 446 includes a slot 447 for holding collar 443. Collar holder 446 and slot 447 are shown more clearly in the perspective view of FIG. 15 without paper advance motor 440. Slot 447 has an open upper end 448 and a lower end 449 that is configured to hold collar 443 of paper advance motor 440. In this example, since collar 443 is circular, slot 447 has a rounded lower end 449. Also in this embodiment, slot 447 has a central axis (dashed line in the middle of slot 447) that is not vertical. Rather, in the view of FIG. 15 the central portion of the lower end 449 is offset to the left relative to the central portion of the upper end 448 of slot 447. During assembly of multifunction printer 100, cylindrical wall 441 of paper advance motor 440 is placed into cradle 445 and collar 443 is inserted into open upper end 448 of slot 447 and then lowered to fit into lower end 449 of slot 447 of collar holder 446. Subsequently when scanning apparatus 500 is assembled onto printer chassis 420, curved securing feature 543 (see FIG. 12) holds cylindrical wall 441 of paper advance motor 440 in position. In some embodiments it is useful to perform tests on printing apparatus 400 prior to completion of the assembly, and it is in such embodiments that the nonvertical slot 447 (described above) can be useful. FIG. 16 shows a number of assembled components of printing apparatus 400, but with printer chassis 420 hidden for clarity. The viewing angle of FIG. 16 is rotated approximately 180 degrees relative to FIG. 15 so that items that point toward the left (such as the upper to lower dashed line indicating the central axis of slot 447) would point toward the right in FIG. 16. FIG. 16 shows paper advance motor 440 together with power transmission elements for driving the feed roller and the discharge roller. In particular, belt 450 is looped around rotatable motor axle 444 of paper advance motor 440 and also around pulley 451. Formed coaxially on the opposite side of pulley 451 is a pulley gear 455 (see FIG. 17) that engages feed roller driving gear 453. Formed coaxially on feed roller driving gear 453 is round projection 454, discussed in further detail below relative to the mounting of the feed roller. Feed roller 436 (see FIG. 6) is hidden by carriage guide 460 in the view of FIG. 16, but is assembled coaxially with feed roller driving gear 453. Feed roller driving gear 453 also transfers rotational power to idler gear 435 and from there to discharge roller gear 437, which rotates discharger roller 438 (see FIG. 6). During assembly of printing apparatus 400, pulley 451 and tensioning pulley 452 are respectively mounted on pulley mounting feature 414 and on axle mount 415 (see also FIG. 17), which are integrally formed on printer chassis 420 (see FIG. 15). When belt 450 is looped around motor axle 444, pulley 451 and tensioning pulley 452, the tension in belt 450 pulls motor axle 444 to the right in FIG. 16 (to the left in FIG. 15), thereby forcing collar 443 against the lower end of nonvertical slot 447. Thus, even before scanning apparatus 500 is assembled onto printer chassis 420, sufficient holding force is applied to paper advance motor 440 so that tests can be performed.

Figure 18:
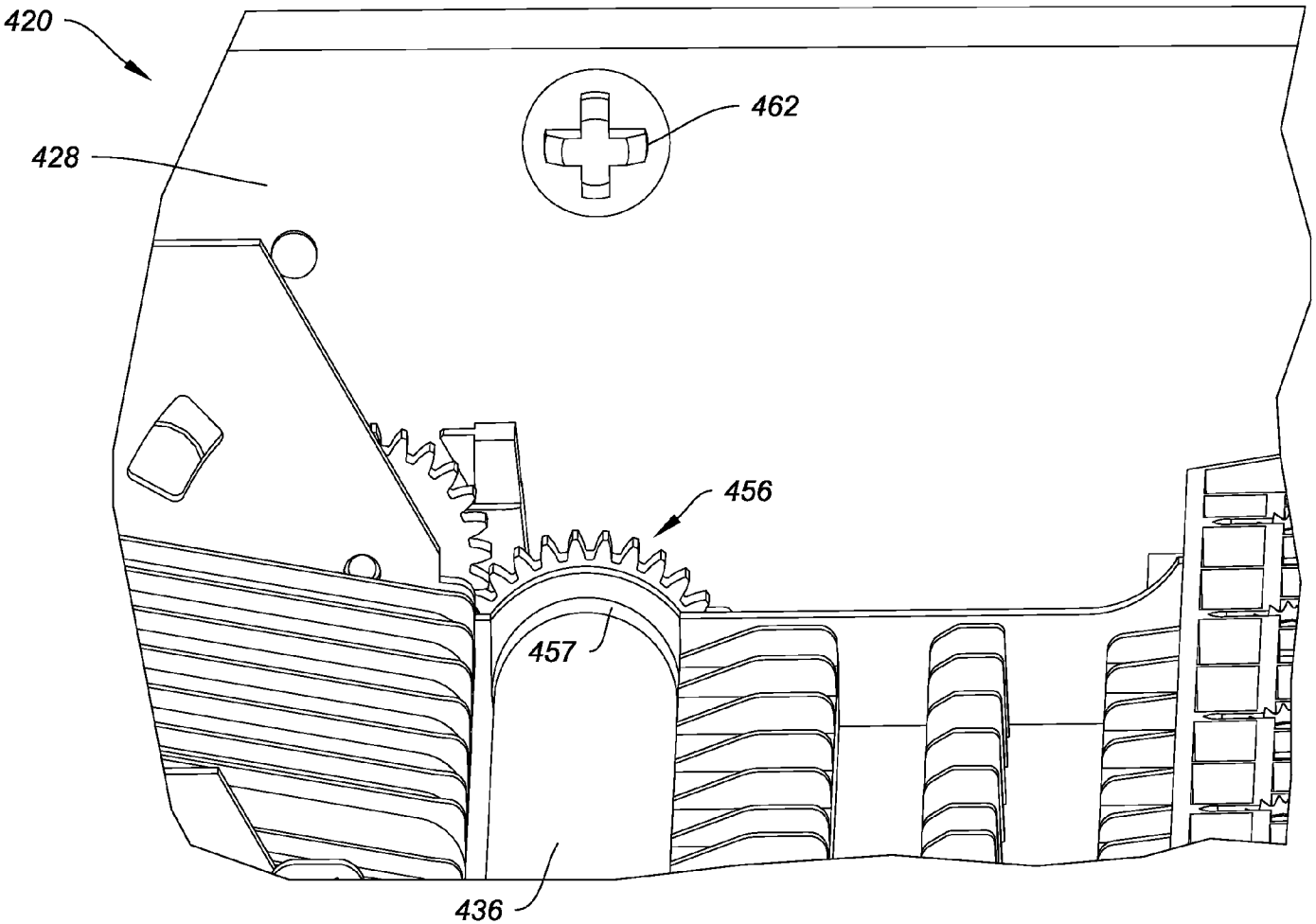
FIG. 18 is a close-up view of a feed roller mounted in a printer chassis.
Figure 19:
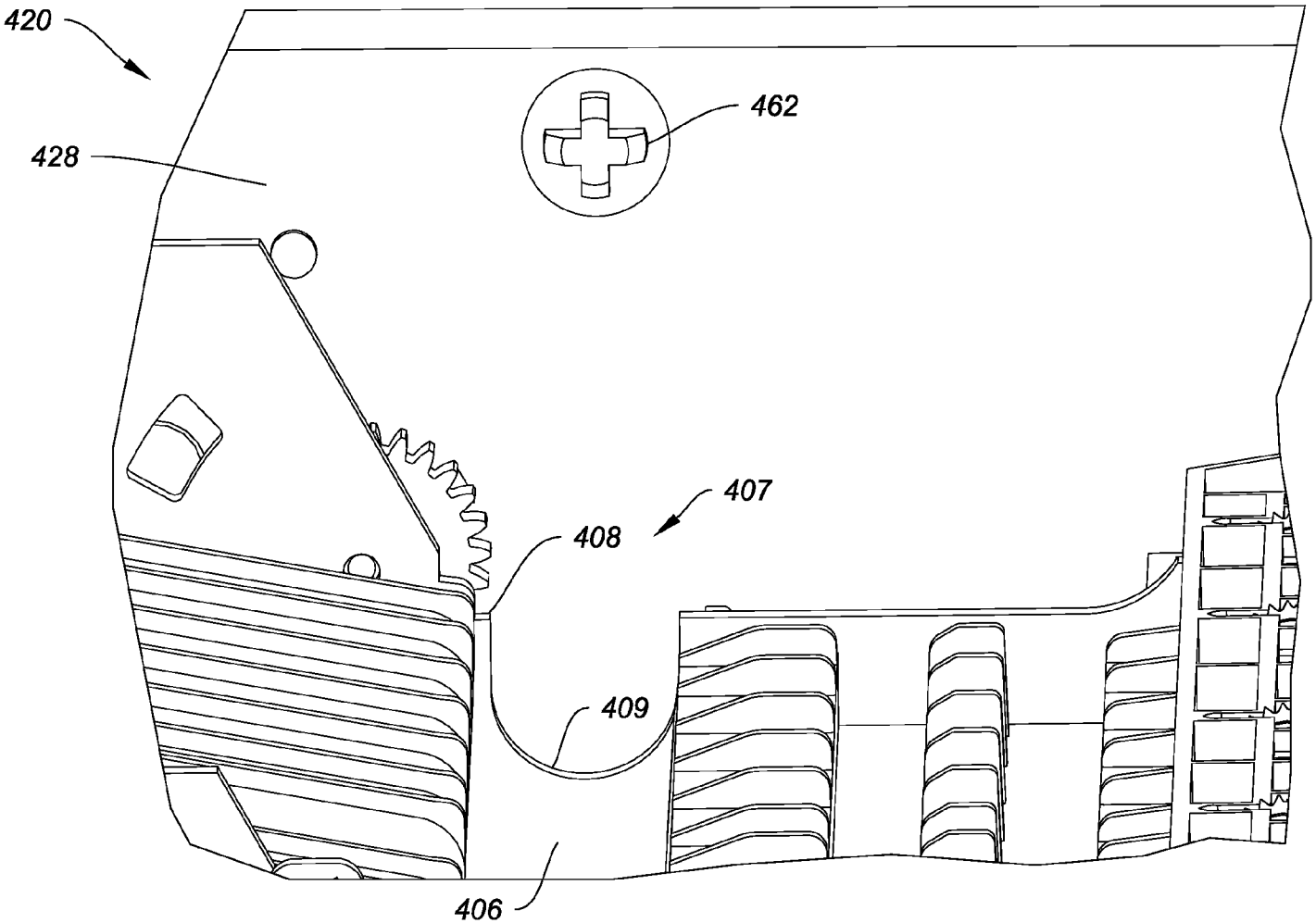
FIG. 19 is similar to FIG. 18 but with the feed roller assembly hidden in order to show a mounting feature in the printer chassis.

The feed roller assembly is yet another example of a component that can be assembled onto support features in the printer chassis 420 and then secured in place when the scanning apparatus 500 of multifunction printer 100 is affixed to the printer chassis 420. The feed roller assembly includes feed roller 436, feed roller drive gear 453 that is coaxially mounted on a first end of feed roller 436 (see FIG. 17), and a power transmission gear 456 (see FIG. 18) that is coaxially mounted on a second end of feed roller 436. Power transmission gear 456 (which can be injection molded from acetal, for example) has a bearing surface 457. FIG. 19 shows the same perspective view as FIG. 18, but with feed roller 436 and power transmission gear 456 hidden in order to show feed-roller support 406 that has been integrally formed with printer chassis 420, for example by injection molding. Feed roller support 406 includes a slot 407 having an open upper end 408 and a rounded lower end 409. When the feed roller assembly is assembled into printer chassis 420, the hearing surface 457 of power transmission gear 456 is inserted through the upper open end 408 of slot 407 and placed into contact with the rounded lower end 409 of slot 407. At the first end of the feed roller assembly, the round projection 454 (see FIG. 16) of feed roller drive gear 453 is inserted into a round hole 416 (see FIG. 15) in feed roller assembly support 417. The feed roller assembly is further secured when spring-biased pinch roller assembly 530 at pinch rollers 532 (see FIGS. 3 and 6), having already been assembled to scanner base 520, is pressed into contact with the rotatable feed roller assembly when the scanning apparatus 500 is assembled to the printer chassis 420, thereby constraining the bearing surface 457 of power transmission gear to be held against the rounded lower end 409 of slot 407.

Figure 20:
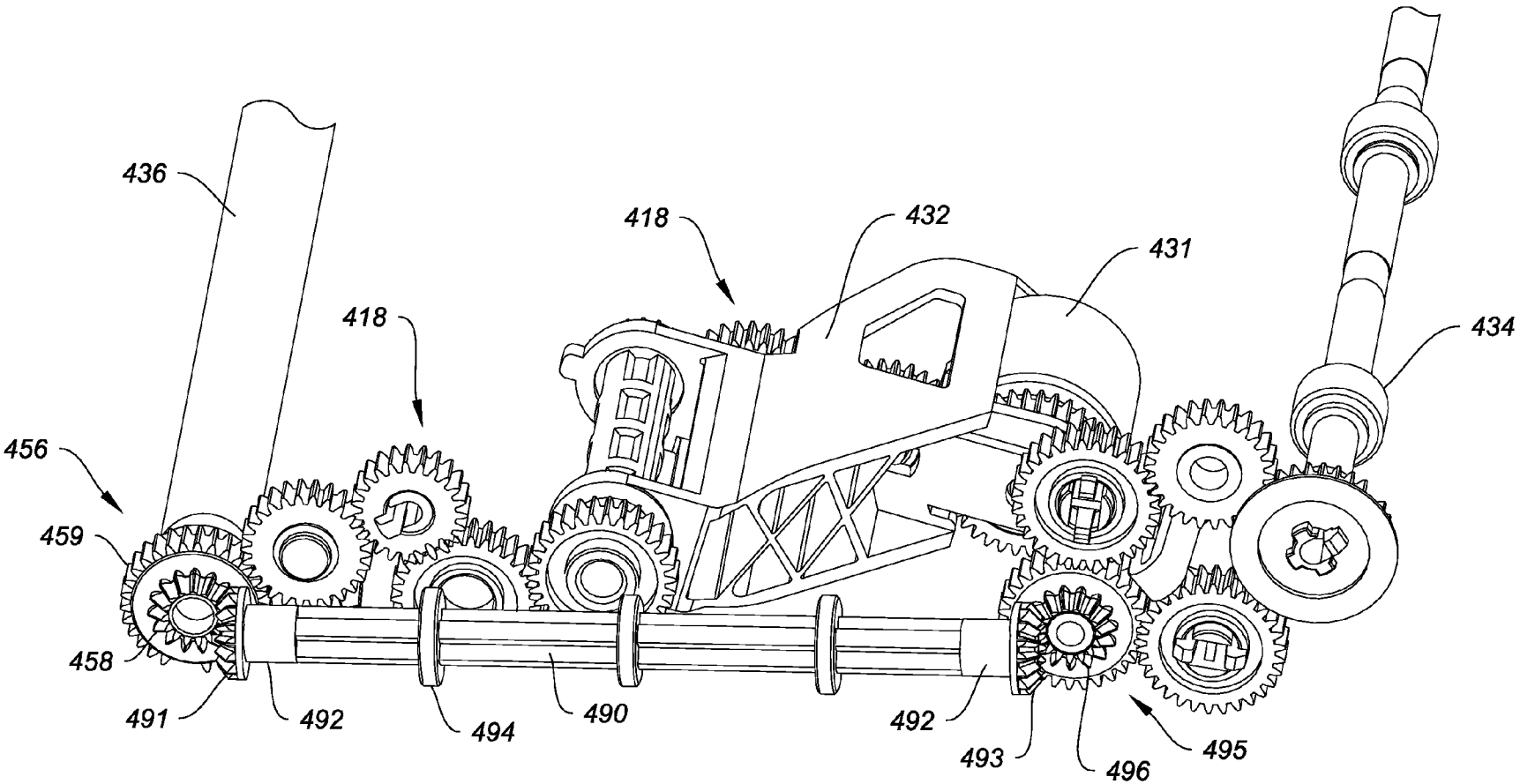
FIG. 20 is a perspective view of portions of the feed roller assembly, the turn roller assembly, a pick roller assembly and a drive shaft according to an embodiment of the invention.
Figure 21:
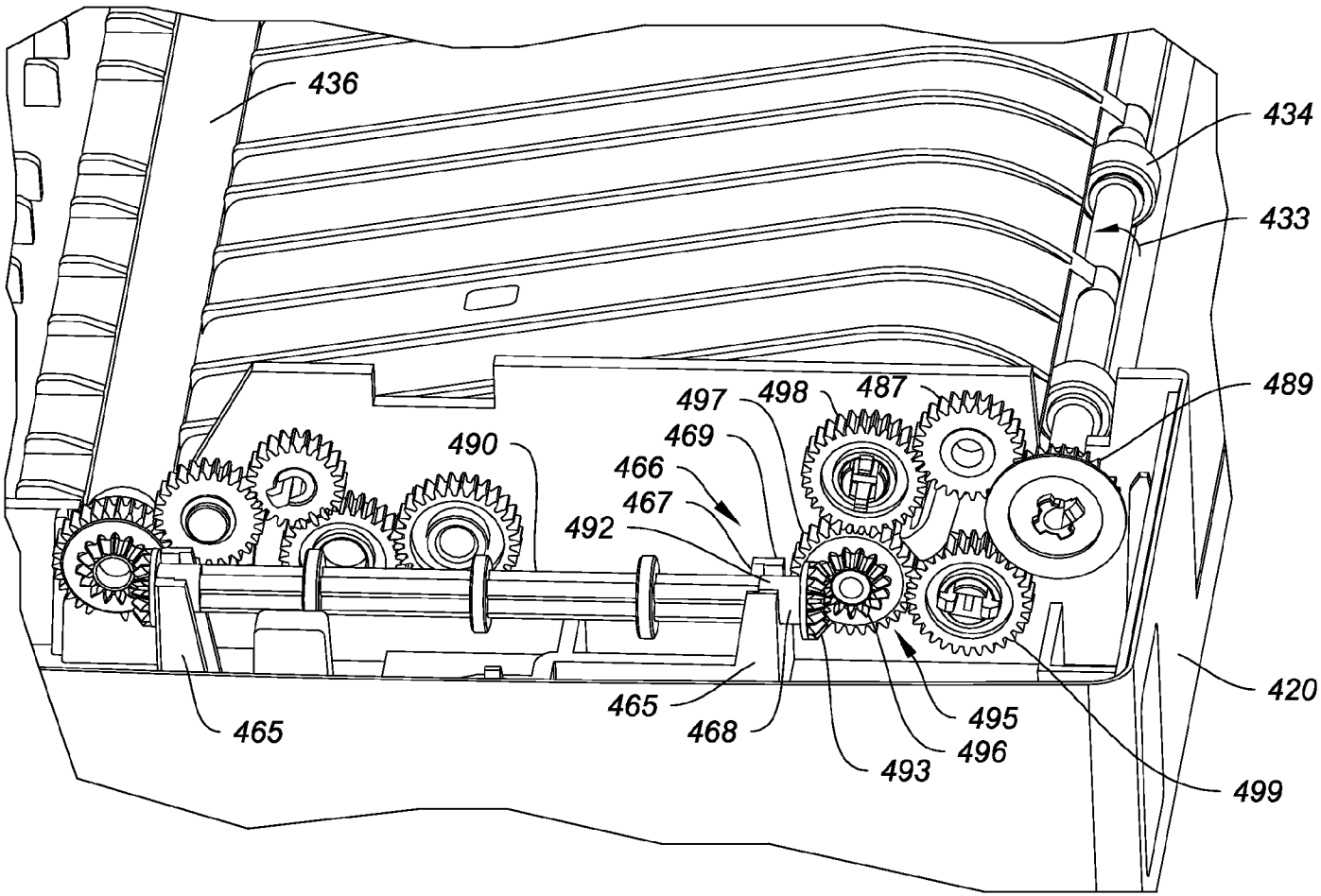
FIG. 21 is a similar view as FIG. 20, but with the components mounted in the printer chassis.
Figure 22:
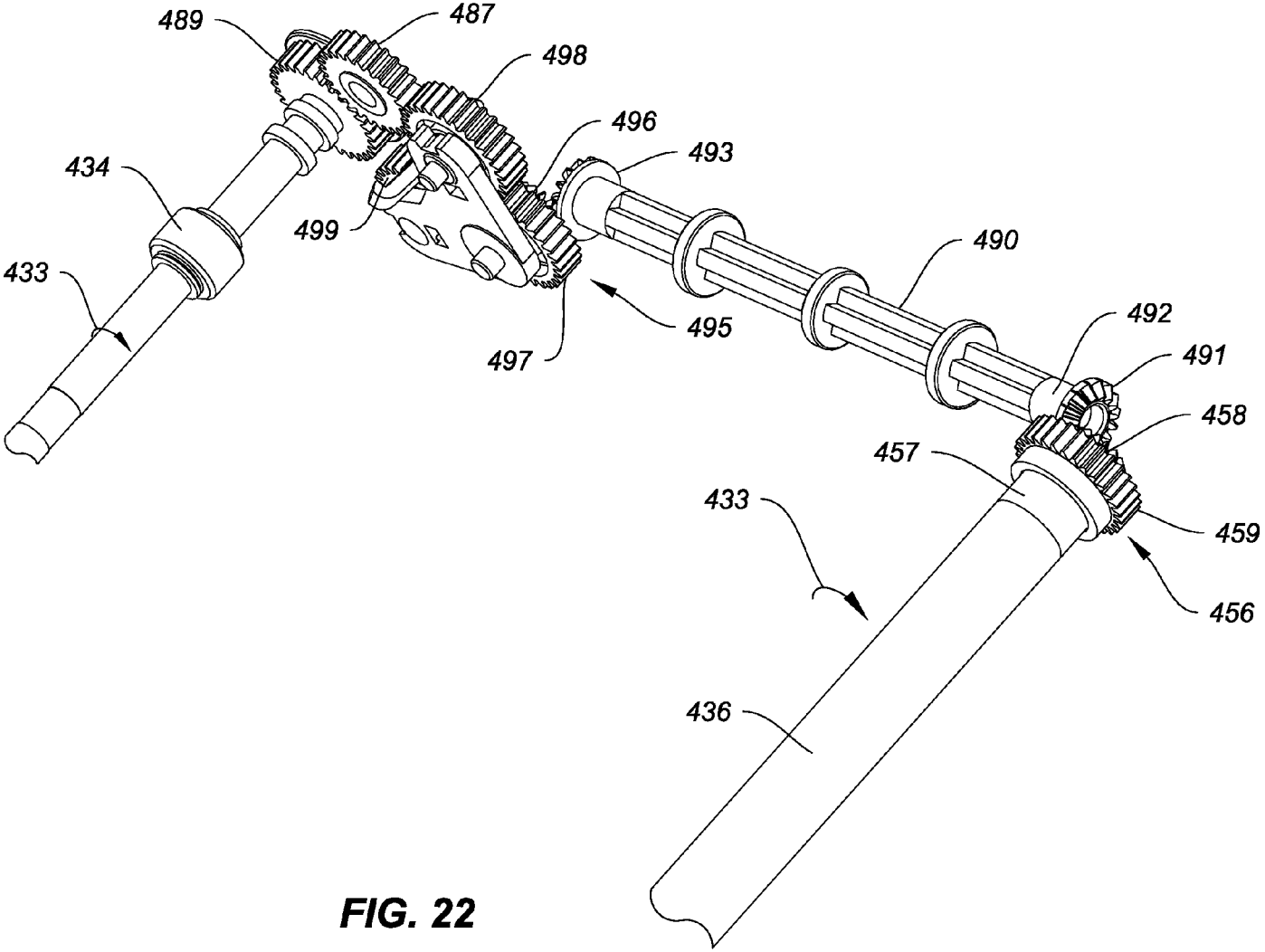
FIG. 22 is a perspective view (rotated relative to FIG. 20) of portions of the feed roller assembly the turn roller assembly and the drive shaft.

Still another example of a component that can be assembled onto support features in the printer chassis 420 and then secured in place when the scanning apparatus 500 of multifunction printer 100 is affixed to the printer chassis 420 is drive shaft 490 that transmits power from power transmission gear 456 of the feed roller assembly to the turn roller assembly, as is described in further detail below and as shown in FIGS. 20-22. Drive shaft 490 is a rotatable shaft having bearing surfaces 492 and optionally one or more rings 494. FIG. 20 shows a portion of the feed roller assembly (including feed roller 436 and power transmission gear 456), turn roller assembly (including turn roller 438 and associated gears), pick roller assembly (including pick roller 431, pick arm 432 and associated gears) and drive shaft 490, but with printer chassis 420 hidden for clarity. FIG. 21 shows the same view but with printer chassis 420 shown. As shown in FIG. 21, integrally formed with printer chassis 420 (for example, by injection molding) are drive shaft supports 465, each including a slot (similar to slot 407 shown in FIG. 19, but sized to accommodate bearing surfaces 492 of drive shaft 490) having an open upper end 467 and a rounded lower end 468. Drive shaft supports 465 also include upper support surfaces 469. When assembling drive shaft 490 into printer chassis 420, bearing surfaces 492 are placed into contact with the rounded lower ends 468 of the slots 466 in drive shaft supports 465. Subsequently, when scanning apparatus 500 is assembled onto printer chassis 420, securing extension 544 (see FIG. 12) comes into contact with upper support surfaces 469 of one of the drive shaft supports 465, and securing extension 546 comes into contact, or nearly into contact with ring 494. Securing extension 544 does not quite come into contact with bearing surface 492, so that the position of drive shaft 490 is constrained but without additional frictional-drag.

The function of drive shaft 490 and its interaction with the other portions of the paper feeding apparatus of printing apparatus 400 will next be described in further detail. The feed roller assembly including feed roller 436, feed roller drive gear 453 and power transmission gear 456, transmit power from paper advance motor 440 to rotate turn roller 434 and pick roller 431 as needed to advance recording medium toward the printing region. Power transmission gear 456 is a compound gear including bevel gear 458 and spur gear 459. When it is necessary to move a piece of recording medium from media input region 412 toward turn rollers 434 (see FIG. 6), a transmission mechanism (not shown) is engaged. Then power to pick roller 431 is transmitted from spur gear 459 through a gear train 418 having a gear that is engaged with spur gear 459 as well as a set of gears on one side of pick arm 432 and a set of gears on the other side of pick arm 432. Spur gears, having gear teeth that are parallel to the rotational axis of the gear are suitable for applications where the load to be driven (such as pick roller 431) requires substantial torque. However, a gear train having many gears tends to add to both the expense and the noise of the printing apparatus. Conventional printers also use a gear train driven by the feed roller assembly to rotate turn roller 434. However, it has been found that drive shaft 490 having a bevel gear 491 at one end to engage with bevel gear 458 of power transmission gear 456 and another bevel gear 493 at the other end of drive shaft 490 to engage with a bevel gear 496 that is coupled to gears for rotating turn roller 434, is able to develop sufficient torque for the turn roller 434 to advance the recording medium through the turn region toward the feed roller 436 (see FIG. 6). Thus, using drive shaft 490 allows elimination of approximately seven gears (depending upon the configuration of the printer) and their associated expense and noise level. In particular, the turn roller assembly includes a compound gear 495 made up of bevel gear 496 and spur gear 497; a first pivot gear 498; a second pivot gear 499; an intermediate gear 489; a drive gear 487; and turn roller 434. Feed roller 436 can rotate either in forward direction 433 or in a reverse direction that is opposite to forward direction 433. Rotating feed roller 436 in forward direction 433 advances recording medium toward print region 424 (see FIG. 6). Feed roller 436 can also be rotated in the reverse direction to deskew the leading edge of recording medium as it approaches the feed roller. However, whether feed roller 436 is rotating in forward direction 433 or reverse direction, it is desired that turn roller 434 (when turning) should always rotate in forward direction 433. This is accomplished through first pivot gear 498, second pivot gear 499 and intermediate gear 487. Spur gear 497 of compound gear 495 is engaged with both first pivot gear 498 and second pivot gear 499. When spur gear 497 is rotated in one direction due to the rotation of feed roller 436, first pivot gear 498 is rotated to engage intermediate gear 489 (as in FIG. 22) which then causes drive gear 489 in forward direction 433. When spur gear 497 is rotated in the opposite direction due to the rotation of the feed roller 436, second pivot gear 499 is rotated to engage directly (i.e. without an intermediate gear) with drive gear 489 to rotate it in the forward direction 433.

A special case of the bevel gear is the miter gear where two meshing gears have equal numbers of teeth and shaft axes that are perpendicular to each other. The example shown in FIGS. 20-22 (the length axis of drive shaft 490 being perpendicular to the length axis of feed roller 436) use miter gears, but other bevel gear embodiments are contemplated.

The invention has been described in detail with particular reference to certain preferred embodiments thereof, but it will be understood that variations and modifications can be effected within the spirit and scope of the invention.

PARTS LIST

| | |
|---|---|
| 100 | Multifunction printer |
| 200 | Carriage |
| 202 | Carriage bearing |
| 204 | Carriage bearing |
| 250 | Printhead |
| 262 | Ink supply |
| 264 | Ink supply |
| 300 | Printer |
| 302 | Load entry direction |
| 303 | Printing region |
| 304 | Direction |
| 305 | Carriage scan direction |
| 306 | Right side |
| 307 | Left side |
| 308 | Front |
| 309 | Rear |
| 310 | Hole |
| 311 | Feed roller gear |
| 312 | Feed roller |
| 313 | Forward direction |
| 330 | Maintenance station |
| 380 | Motor |
| 381 | Screw |
| 382 | Guide rail |
| 383 | Axle |
| 384 | Belt |
| 385 | Backbone |
| 386 | Rotational axis of pulley |
| 390 | Electronics board |
| 392 | Cable connectors |
| 400 | Printing apparatus |
| 402 | Line (parallel to base of printer chassis) |
| 405 | Power supply |
| 406 | Feed roller assembly support |
| 407 | Slot |
| 408 | Upper end (of slot) |
| 409 | Lower end (of slot) |
| 410 | Door |
| 412 | Media input region |
| 414 | Pulley mounting feature |
| 415 | Axle mount (for tensioning pulley) |
| 416 | Hole |
| 417 | Feed roller assembly support |
| 418 | Gear train (for pick roller) |
| 420 | Printer chassis |
| 421 | Base (of printer chassis) |
| 422 | Media support element |

-continued

| | |
|---|---|
| 423 | Ribs (on media support element) |
| 424 | Printing region |
| 425 | Ribs (in printing region) |
| 426 | Discharge region |
| 428 | Side wall |
| 429 | Upper rim (of side wall) |
| 430 | Media transport path |
| 431 | Pick roller |
| 432 | Pick arm |
| 433 | Forward rotation direction |
| 434 | Turn roller |
| 435 | Idler gear |
| 436 | Feed roller |
| 437 | Discharge roller gear |
| 438 | Discharge roller |
| 439 | Star wheel assembly |
| 440 | Paper advance motor |
| 441 | Cylindrical wall (of paper advance motor) |
| 442 | Face (of paper advance motor) |
| 443 | Collar (of paper advance motor) |
| 444 | Axle (of paper advance motor) |
| 445 | Cradle (for paper advance motor) |
| 446 | Collar holder (for paper advance motor) |
| 447 | Slot |
| 448 | Upper end (of slot) |
| 449 | Lower end (of slot) |
| 450 | Belt |
| 451 | Pulley |
| 452 | Tensioning pulley |
| 453 | Feed roller drive gear |
| 454 | Round projection |
| 455 | Pulley gear |
| 456 | Power transmission gear |
| 457 | Bearing surface |
| 458 | Bevel gear (of power transmission gear) |
| 459 | Spur gear (of power transmission gear) |
| 460 | Carriage guide |
| 461 | Open end (of carriage guide) |
| 462 | Retainer (for carriage guide) |
| 464 | Axis (of carriage guide) |
| 465 | Drive shaft support |
| 466 | Slot |
| 467 | Upper end |
| 468 | Lower end |
| 469 | Upper support surfaces |
| 470 | Carriage motor |
| 471 | Outer casing (of carriage motor) |
| 472 | Upper edge (of carriage motor) |
| 473 | Axis |
| 474 | Axle (of carriage motor) |
| 475 | Inclined cradle |
| 476 | Holding feature (of inclined cradle) |
| 477 | Cylindrical wall (of carriage motor) |
| 478 | Face (of carriage motor) |
| 479 | Electrical term inal(s) |
| 480 | Belt (for carriage) |
| 481 | First section (of belt) |
| 482 | Second section (of belt) |
| 484 | Teeth (of belt) |
| 485 | Belt attachment |
| 486 | Radial line (from axis of carriage guide) |
| 487 | Intermediate gear |
| 488 | Idler pulley |
| 489 | Drive gear (for turn roller assembly) |
| 490 | Drive shaft (fin turn roller assembly) |
| 491 | Bevel gear (of drive shaft) |
| 492 | Bearing surface(s) |
| 493 | Bevel gear (of drive shaft) |
| 494 | Ring (of drive shaft) |
| 495 | Compound gear (of turn roller assembly) |
| 496 | Bevel gear (of compound gear) |
| 497 | Spur gear (of compound gear) |
| 498 | First pivot gear |
| 499 | Second pivot gear |
| 500 | Scanning apparatus |
| 501 | Outer rim |
| 505 | Case |
| 506 | Lower rim |
| 508 | Attachment tab(s) |
| 510 | Transparent platen |

-continued

| | |
|---|---|
| 512 | Control |
| 514 | Indicator |
| 516 | Printed circuit board |
| 520 | Scanner base |
| 521 | Dashed line representing contour of scanner base bottom |
| 522 | Supports (for platen glass) |
| 524 | Rack |
| 525 | Scanner housing |
| 526 | Bottom surface (of scanner base) |
| 528 | First region (of scanner base bottom) |
| 529 | Second region (of scanner base bottom) |
| 530 | Pinch roller assembly |
| 532 | Pinch rollers |
| 533 | Nip |
| 534 | Bottom surface (of pinch roller assembly) |
| 536 | Finger(s) |
| 538 | Spring(s) |
| 540 | Motor holding feature |
| 541 | First portion (of motor holding feature) |
| 542 | Second portion (of motor holding feature) |
| 543 | Curved securing feature |
| 544 | Securing extension |
| 546 | Securing extension |

The invention claimed is:

1. A paper feeding apparatus for a printer comprising:

a motor;

a first roller assembly including:

a) a first roller having a first end, a second end and an axis;

b) a first gear disposed at the first end of the first roller, wherein the first gear is configured to be driven by the motor; and c) a second gear disposed at the second end of the first roller, wherein the second gear comprises a first bevel gear;

a drive shall including a first end, a second end and an axis, wherein the first end of the drive shaft comprises a second bevel gear that is configured to engage with the first bevel gear of the second gear of the first roller assembly, and wherein the second end of the drive shaft comprises a third bevel gear; and a second roller assembly including a second roller and a fourth bevel gear that is configured to engage with the third bevel gear at the second end of the drive shaft.

2. The paper feeding apparatus of claim 1, wherein the axis of the drive shaft is substantially perpendicular to the axis of the first roller.

3. The paper feeding apparatus of claim 1, wherein the second gear of the first roller assembly comprises a compound gear including the first bevel gear and a spur gear.

4. The paper feeding apparatus of claim 3 further comprising a third roller assembly including a gear train, wherein the spur gear of the second gear of the first roller assembly is configured to engage with a gear of the gear train of the third roller assembly.

5. The paper feeding apparatus of claim 1, wherein the second gear of the first roller assembly further comprises a bearing surface.

6. The paper feeding apparatus of claim 1, the second roller assembly including a compound gear comprising the fourth bevel gear and a spur gear.

7. The paper feeding apparatus of claim 6 further comprising a first pivot gear and a second pivot gear, wherein the spur gear of the compound gear of the second roller assembly is configured to transmit power to the second roller via one of the first pivot gear or the second pivot gear, depending upon a direction of rotation of the first roller.

8. A printer comprising a printing device;

a printing region where the printing device is configured to print on a recording medium;

a motor;

a media input region;

a first roller assembly for moving a recording medium toward the printing region, the first roller assembly including:

a) a first roller having a first end, a second end and an axis;

b) a first gear disposed at the first end of the first roller, wherein the first gear is configured to be driven by the motor; and c) a second gear disposed at the second end of the first roller, wherein the second gear comprises a first bevel gear;

a drive shaft including a first end, a second end and an axis, wherein the first end of the drive shall comprises a second bevel gear that is configured to engage with the first bevel gear of the second gear of the first roller assembly, and wherein the second end of the drive shaft comprises a third bevel gear; and a second roller assembly for moving the recording medium toward the first roller assembly, the second roller assembly including a second roller and a fourth bevel gear that is configured to engage with the third bevel gear at the second end of the drive shaft.

9. The printer of claim 8 further comprising a turn region, wherein the second roller assembly is located in the turn region.

10. The printer of claim 8, wherein the axis of the drive shaft is substantially perpendicular to the axis of the first roller.

11. The printer of claim 8, wherein the second gear of the first roller assembly comprises a compound gear including the first bevel gear and a spur gear.

12. The printer of claim 11 further comprising a third roller assembly including a gear train, wherein the spur gear of the second gear of the first roller assembly is configured to engage with a gear of the gear train of the third roller assembly.

13. The printer of claim 12, wherein the third roller assembly is configured to move the recording medium from the media input region toward the second roller assembly.

14. The printer of claim 8, wherein the second gear of the first roller assembly further comprises a bearing surface.

15. The printer of claim 14 further comprising a support feature including a slot having an open upper end and a rounded lower end, wherein the bearing surface of the second gear of the first roller assembly is in contact with the rounded lower end of the slot of the support feature.

16. The printer of claim 8, the second roller assembly including a compound gear comprising the fourth bevel gear and a spur gear.

17. The printer of claim 16 further comprising a first pivot gear and a second pivot gear, wherein the spur gear of the compound gear of the second roller assembly is configured to transmit power to the Second roller via one of the first pivot gear or the second pivot gear, depending upon a direction of rotation of the first roller.

* * * * *